US010431891B2

(12) United States Patent
Svendsen et al.

(10) Patent No.: US 10,431,891 B2
(45) **Date of Patent: *Oct. 1, 2019**

(54) ANTENNA ARRANGEMENT

(71) Applicant: Intel IP Corporation, Santa Clara, CA (US)

(72) Inventors: Simon Svendsen, Aalborg (DK); Ole Jagielski, Frederikshavn (DK)

(73) Assignee: Intel IP Corporation, Santa Clara, CA (US)

( * ) Notice: Subject to any disclaimer, the term of this patent is extended or adjusted under 35 U.S.C. 154(b) by 36 days.

This patent is subject to a terminal disclaimer.

(21) Appl. No.: 14/757,569

(22) Filed: Dec. 24, 2015

(65) Prior Publication Data

US 2017/0187113 A1 Jun. 29, 2017

(51) Int. Cl.

| | |
|---|---|
| ***H01Q 9/04*** | (2006.01) |
| ***H01Q 1/52*** | (2006.01) |
| ***H01Q 9/42*** | (2006.01) |
| ***H01Q 21/28*** | (2006.01) |
| ***H01Q 5/314*** | (2015.01) |
| ***H01Q 5/378*** | (2015.01) |

(52) U.S. Cl.

CPC ..... *H01Q 9/04* (2013.01); *H01Q 1/521* (2013.01); *H01Q 5/314* (2015.01); *H01Q 5/378* (2015.01); *H01Q 9/42* (2013.01); *H01Q 21/28* (2013.01)

(58) Field of Classification Search

CPC ..... H01Q 1/521; H01Q 1/523; H01Q 9/0457

See application file for complete search history.

(56) References Cited

U.S. PATENT DOCUMENTS

| | | | | |
|---|---|---|---|---|
| 6,295,030 | B1 | 9/2001 | Kozakai et al. | |
| 2005/0057407 | A1 | 3/2005 | Imaizumi et al. | |
| 2005/0184914 | A1 | 8/2005 | Ollikainen et al. | |
| 2007/0001911 | A1 | 1/2007 | Fujio et al. | |
| 2007/0152887 | A1 | 7/2007 | Castany et al. | |
| 2007/0268191 | A1 | 11/2007 | Ishizuka et al. | |
| 2007/0285321 | A1 | 12/2007 | Chung et al. | |
| 2008/0018539 | A1 | 1/2008 | Jung et al. | |
| 2009/0033561 | A1 | 2/2009 | Pros et al. | |
| 2010/0156741 | A1 | 6/2010 | Vazquez et al. | |
| 2010/0238072 | A1 | 9/2010 | Ayatollahi et al. | |
| 2011/0050528 | A1 | 3/2011 | Montgomery | |
| 2011/0228713 | A1* | 9/2011 | Alexopoulos | H01Q 1/521 370/297 |
| 2011/0237207 | A1* | 9/2011 | Bauder | H01Q 1/521 455/78 |
| 2011/0298669 | A1 | 12/2011 | Rao et al. | |
| 2013/0076580 | A1 | 3/2013 | Zhang et al. | |
| 2013/0099980 | A1 | 4/2013 | Hayashi | |
| 2013/0120201 | A1 | 5/2013 | Park et al. | |
| 2013/0162497 | A1* | 6/2013 | Satou | H01Q 5/35 343/853 |
| 2013/0187817 | A1 | 7/2013 | Jagielski et al. | |
| 2013/0257674 | A1* | 10/2013 | Li | H01Q 5/321 343/853 |
| 2013/0293425 | A1 | 11/2013 | Zhu et al. | |
| 2014/0043201 | A1 | 2/2014 | Pelosi et al. | |

(Continued)

*Primary Examiner* — Daniel Munoz

(74) *Attorney, Agent, or Firm* — Schiff Hardin LLP

(57) ABSTRACT

An antenna arrangement is provided. The antenna arrangement includes a first antenna element and a second antenna element. An inductance coil is coupled to the first antenna element and the second antenna element.

19 Claims, 18 Drawing Sheets

(56) References Cited

U.S. PATENT DOCUMENTS

| | | | | |
|---|---|---|---|---|
| 2014/0162572 | A1 | 6/2014 | Hirabayashi | |
| 2015/0002367 | A1 | 1/2015 | Kosaka et al. | |
| 2015/0180123 | A1 | 6/2015 | Tatomirescu et al. | |
| 2016/0111777 | A1 | 4/2016 | Yang | |
| 2016/0248154 | A1* | 8/2016 | Tian | H01Q 1/243 |
| 2017/0077599 | A1* | 3/2017 | Sayama | H01Q 1/523 |
| 2019/0006734 | A1 | 1/2019 | Svendsen et al. | |

* cited by examiner

| | Bandwith: | % Bandwith | S11 LowerTX: | S11 LowerTX: | S11 LowerRX: | S11 UpperRX: |
|---|---|---|---|---|---|---|
| WLAN 2.4 Ghz | 136.6 Mhz | 5.6% | -8.4dB | -10.3 dB | -8.4dB | -10.3dB |
| WLAN 5.6 Ghz | 3063.8 Mhz | 52.6% | -9.8dB | -10.4 dB | -9.8dB | -10.4dB |
| WLAN 2.4 Ghz | 136.6 Mhz | 5.6% | -10.0dB | -9.1 dB | -10.0dB | -9.1dB |
| WLAN 5.6 Ghz | 2345.3 Mhz | 38.8% | -7.9dB | -12.8 dB | -7.9dB | -12.8dB |

| | Marker#1 | Marker#2 | Marker#3 | Marker#4 | Marker#5 |
|---|---|---|---|---|---|
| S21 | -27.0 dB | -27.1 dB | -18.2 dB | -17.4 dB | -18.2 dB |
| Frequency | 2400.0 MHz | 2483.1 MHz | 5149.1 MHz | 5499.4 MHz | 5849.7 MHz |
| | Marker#1 | Marker#2 | Marker#3 | Marker#4 | Marker#5 |
| S21 | -8.2 dB | -6.4 dB | -8.5 dB | -10.3 dB | -10.5 dB |
| Frequency | 2400.0 MHz | 2483.1 MHz | 5149.1 MHz | 5499.4 MHz | 5849.7 MHz |

ANTENNA ARRANGEMENT

FIELD

Examples relate antenna structures for communication devices. In particular, examples relate to antenna arrangements.

BACKGROUND

Mobile communications devices comprise a plurality of antennas for supporting different communication standards. In order to achieve a good performance, a certain allocated volume is required for each of the antennas. Furthermore, the placing of an antenna within the mobile communications device is an important aspect for the antenna's performance. For example, placing an antenna at the circumference of the mobile communications device may allow for good performance. Moreover, isolation between the antennas is an important aspect (especially for antennas operating at the same frequency). Conventionally, antennas are spaced away from each other in order to provide a sufficient isolation. However, the design of mobile communications devices (e.g. a smartphone, a tablet computer or a laptop) is tending to reduce the bezel around the display of the mobile communications device, and to use full-metal bodies in order to reduce the thickness of the device while maintaining the mechanical strength. That is, the available volume within the mobile communications device is limited.

Hence, there may be a desire for a concept allowing to reduce distances between the antennas.

BRIEF DESCRIPTION OF THE FIGURES

Some examples of apparatuses and/or methods will be described in the following by way of example only, and with reference to the accompanying figures, in which.

DETAILED DESCRIPTION

Figure 1:
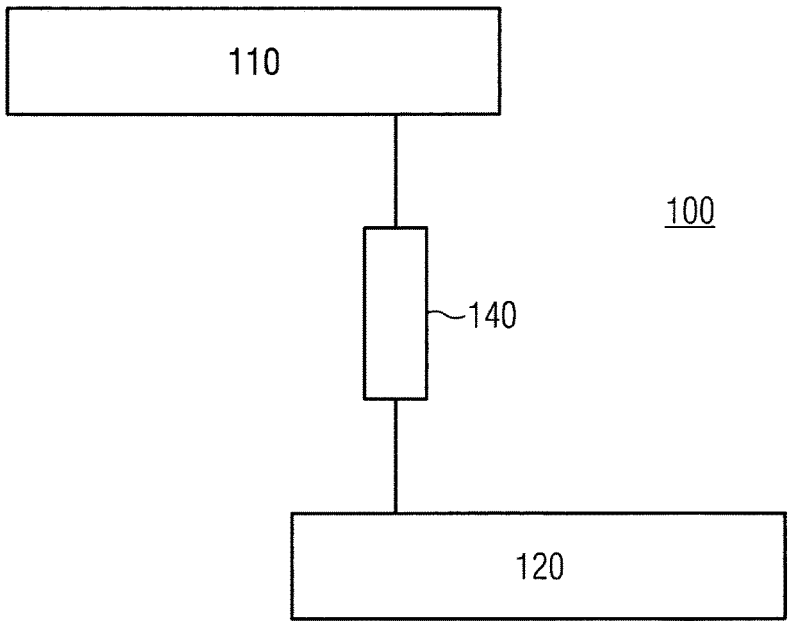
FIG. 1 illustrates an example of an antenna arrangement.

Various examples will now be described more fully with reference to the accompanying drawings in which some examples are illustrated. In the figures, the thicknesses of lines, layers and/or regions may be exaggerated for clarity.

Accordingly, while further examples are capable of various modifications and alternative forms, some particular examples thereof are shown in the figures and will subsequently be described in detail. However, this detailed description does not limit further examples to the particular forms described. Further examples may cover all modifications, equivalents, and alternatives falling within the scope of the disclosure. Like numbers refer to like or similar elements throughout the description of the figures, which may be implemented identically or in modified form when compared to one another while providing for the same or a similar functionality.

It will be understood that when an element is referred to as being "connected" or "coupled" to another element, the elements may be directly connected or coupled or via one or more intervening elements. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", to name just a few examples).

The terminology used herein is for the purpose of describing particular examples is not intended to be limiting for further examples. Whenever a singular form such as "a," "an" and "the" is used and using only a single element is neither explicitly or implicitly defined as being mandatory, further examples may also plural elements to implement the same functionality. Likewise, when a functionality is subsequently described as being implemented using multiple elements, further examples may implement the same functionality using a single element or processing entity. It will be further understood that the terms "comprises," "comprising," "includes" and/or "including," when used, specify the presence of the stated features, integers, steps, operations, processes, acts, elements and/or components, but do not preclude the presence or addition of one or more other features, integers, steps, operations, processes, acts, elements, components and/or any group thereof.

Unless otherwise defined, all terms (including technical and scientific terms) are used herein in their ordinary meaning of the art to which the examples belong, unless expressly defined otherwise herein.

In the following, various examples relate to devices (e.g. cell phone, base station) or components (e.g. transmitter, transceiver) of devices used in wireless or mobile communications systems. A mobile communication system may, for example, correspond to one of the mobile communication systems standardized by the 3rd Generation Partnership Project (3GPP), e.g. Global System for Mobile Communications (GSM), Enhanced Data rates for GSM Evolution (EDGE), GSM EDGE Radio Access Network (GERAN), High Speed Packet Access (HSPA), Universal Terrestrial Radio Access Network (UTRAN) or Evolved UTRAN (EUTRAN), Long Term Evolution (LTE) or LTE-Advanced (LTE-A), or mobile communication systems with different standards, e.g. Worldwide Interoperability for Microwave Access (WIMAX) IEEE 802.16 or Wireless Local Area Network (WLAN) IEEE 802.11, generally any system based on Time Division Multiple Access (TDMA), Frequency Division Multiple Access (FDMA), Orthogonal Frequency Division Multiple Access (OFDMA), Code Division Multiple Access (CDMA), etc. The terms mobile communication system and mobile communication network may be used synonymously.

The mobile communication system may comprise a plurality of transmission points or base station transceivers operable to communicate radio signals with a mobile transceiver. In some examples, the mobile communication system may comprise mobile transceivers, relay station transceivers and base station transceivers. The relay station transceivers and base station transceivers can be composed of one or more central units and one or more remote units.

A mobile transceiver or mobile device may correspond to a smartphone, a cell phone, User Equipment (UE), a laptop, a notebook, a personal computer, a Personal Digital Assistant (PDA), a Universal Serial Bus (USB)-stick, a tablet computer, a car, etc. A mobile transceiver or terminal may also be referred to as UE or user in line with the 3GPP terminology. A base station transceiver can be located in the fixed or stationary part of the network or system. A base station transceiver may correspond to a remote radio head, a transmission point, an access point, a macro cell, a small cell, a micro cell, a pico cell, a femto cell, a metro cell etc. The term small cell may refer to any cell smaller than a macro cell, i.e. a micro cell, a pico cell, a femto cell, or a metro cell. Moreover, a femto cell is considered smaller than a pico cell, which is considered smaller than a micro cell. A base station transceiver can be a wireless interface of a wired network, which enables transmission and reception of radio signals to a UE, mobile transceiver or relay transceiver. Such a radio signal may comply with radio signals as, for example, standardized by 3GPP or, generally, in line with one or more of the above listed systems. Thus, a base station transceiver may correspond to a NodeB, an eNodeB, a BTS, an access point, etc. A relay station transceiver may correspond to an intermediate network node in the communication path between a base station transceiver and a mobile station transceiver. A relay station transceiver may forward a signal received from a mobile transceiver to a base station transceiver, signals received from the base station transceiver to the mobile station transceiver, respectively.

The mobile communication system may be cellular. The term cell refers to a coverage area of radio services provided by a transmission point, a remote unit, a remote head, a remote radio head, a base station transceiver, relay transceiver or a NodeB, an eNodeB, respectively. The terms cell and base station transceiver may be used synonymously. In some examples a cell may correspond to a sector. For example, sectors can be achieved using sector antennas, which provide a characteristic for covering an angular section around a base station transceiver or remote unit. In some examples, a base station transceiver or remote unit may, for example, operate three or six cells covering sectors of 120° (in case of three cells), 60° (in case of six cells) respectively. Likewise a relay transceiver may establish one or more cells in its coverage area. A mobile transceiver can be registered or associated with at least one cell, i.e. it can be associated to a cell such that data can be exchanged between the network and the mobile in the coverage area of the associated cell using a dedicated channel, link or connection. A mobile transceiver may hence register or be associated with a relay station or base station transceiver directly or indirectly, where an indirect registration or association may be through one or more relay transceivers.

FIG. 1 illustrates an antenna arrangement 100. The antenna arrangement 100 comprises a first antenna element 110 and a second antenna element 120.

The first antenna element 110 and the second antenna element 120 are both resonating elements, which are configured to radiate an electromagnetic wave to the environment based on a transmit signal fed to the respective antenna element. For example, the first antenna element 110 and the second antenna element 120 may be both configured to resonate at a same first resonance frequency (e.g. 2.4 GHz). In some examples, the first antenna element 110 may be configured to resonate at a first frequency, and the second antenna element 120 may be configured to resonate at a different second resonance frequency. Vice versa, the antenna elements are further configured to receive an electromagnetic wave, which relates to a receive signal, from the environment.

An inductance coil 140 is coupled to the first antenna element 110 and the second antenna element 120. The inductance coil 140 allows to highly isolate the first antenna element 110 and the second antenna element 120. For example, the inductance coil 140 may allow to provide a high isolation between both antenna elements over a wide frequency range. Accordingly, a distance between the first antenna element 110 and the second antenna element 120 may be chosen small. In other words, the required combined volume for the first antenna element 110 and the second antenna element 120 may be reduced compared to conventional antenna structures. Especially for the first antenna element 110 and the second antenna element 120 resonating at a same frequency, a distance between both antenna elements may be greatly reduced compared to conventional antenna structures. Hence, the antenna element 100 may, e.g., be used in a mobile communications device providing only a limited volume for the antenna elements.

Figure 2:
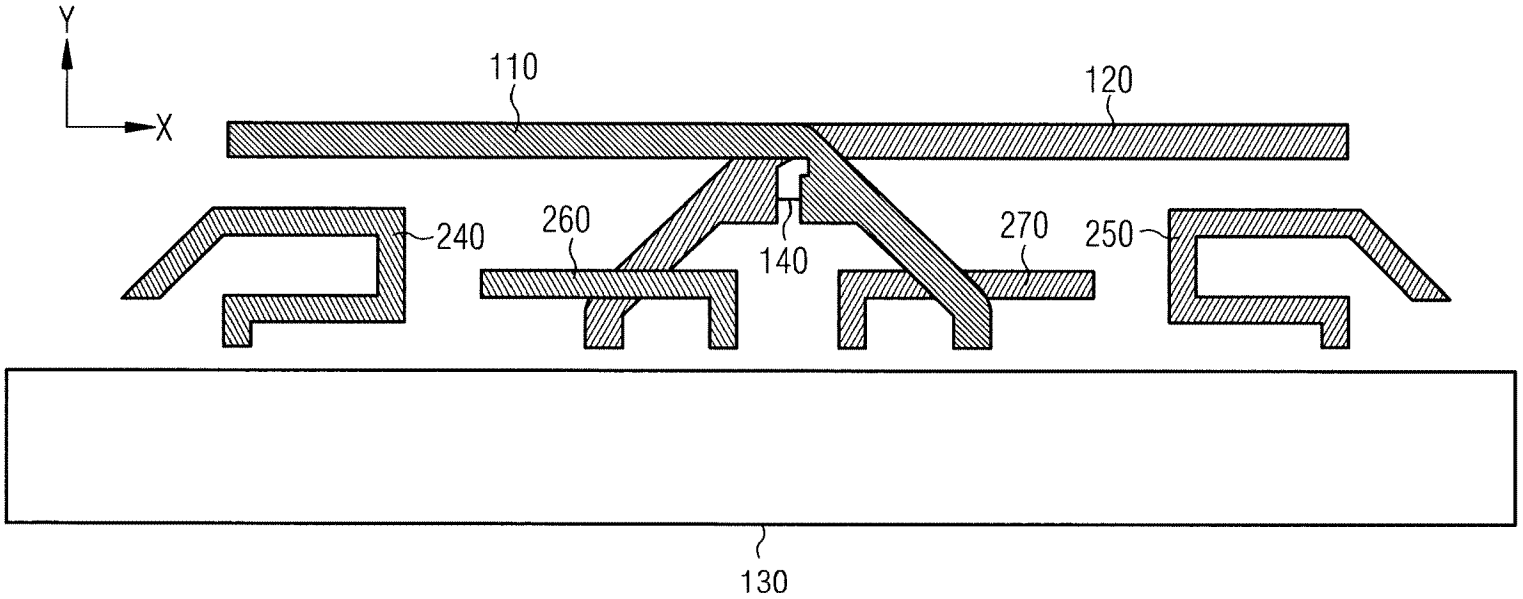
FIG. 2 illustrates another example of an antenna arrangement.

FIG. 2 illustrates another antenna arrangement 200, in which the first antenna element 110 is arranged on a first surface of a support plane 130, whereas the second antenna element 120 is arranged on a second surface of the support plane 130. The support plane 130 may, e.g., be a Printed Circuit Board (PCB) or a carrier plastic part. In FIG. 2, the support plane is merely indicated by the area 130 for a better visualization of the arrangement of the first and second antenna elements 110, 120 on opposite sides of the support plane 130. In the example illustrated in FIG. 2, the first antenna element 110 is arranged on the top side of the support plane 130, which can be seen by the observer. The second antenna element 120 is arranged on the bottom side of the support plane 130, which cannot be easily seen by the observer in FIG. 2 due to the chosen perspective of the illustration. An inductance coil 140 is coupled to both the first antenna element 110 and the second antenna element 120 in order to provide a sufficient (high) isolation between the antenna elements.

The arrangement of the two antenna elements on opposite surfaces (sides) of the support plane 130 may allow for an area and volume efficient arrangement of the antenna elements. As illustrated in FIG. 2, an extension of the first antenna element 110 along a first spatial axis x may be at least partly equal to an extension of the second antenna element 120 along the first spatial axis x. In other words, the first antenna element 110 and the second antenna element 120 may at least partly overlap along the first spatial axis x. Furthermore, an extension of the first antenna element 110 along a second spatial axis y (which is orthogonal to the first spatial axis x) may be at least partly equal to an extension of the second antenna element 120 along the second spatial axis y. In other words, the first antenna element 110 and the second antenna element 120 may at least partly overlap along the second spatial axis y. As illustrated in FIG. 2, the first antenna element 110 and the second antenna element 120 may also completely overlap along the second spatial axis. It is evident from FIG. 2 that the first spatial axis x and the second spatial axis y span the support plane 130. That is, none of the first spatial axis x and the second spatial axis y is orthogonal to the support plane 130.

In alternative examples, the first antenna element 110 and the second antenna element 120 may be arranged on a same surface of a support plane 130 (e.g. the top side or the bottom side). Further, if the support plane comprises multiple layers (i.e. two or more), the first antenna element 110 may be arranged on a surface of the support plane 130 (e.g. the top side or the bottom side), wherein the second antenna element 120 may be arranged on one of the intermediate layers of the support plane 130. Alternatively, the first antenna element 110 may be arranged on a first intermediate layer of the support plane 130, wherein the second antenna element 120 may be arranged on a second intermediate layer of the support plane 130. In this respect, the first intermediate layer and the second intermediate layer of the support plane may be identical or different from each other.

In FIG. 2, further an indirect feeding structure for both antenna elements is illustrated. A first coupling element 240 is arranged on the first surface of the support plane 130, which is galvanically isolated from the first antenna element 110. The first coupling element 240 capacitively couples to the first antenna element 110. A second coupling element 250 is arranged on the second surface of the support plane 130, which is galvanically isolated from the second antenna element 120. The second coupling element 250 capacitively couples to the second antenna element 120. The first coupling element 240 and the second coupling element 250 may, e.g., be metal structures having a defined resonance frequency. Hence, a transmit signal for the first antenna element 110 (e.g. a radio frequency transmit signal) may be directly fed (provided) to the first coupling element 240. Due to the capacitive coupling between the first coupling element 240 and the first antenna element 110, the transmit signal may be provided to the first antenna element 110 for radiation to the environment. The indirect feeding may allow to match the impedance of the first antenna element 110 to 50Ω. Similarly, the second coupling element 250 may be used to indirectly feed a transmit signal for the second antenna element 120 to the second antenna element 120 (while the second coupling element 250 directly receives the transmit signal). Hence, also for the second antenna element 120, the impedance may be matched to 50Ω. In other words, at least one the first coupling element 240 and the second coupling element 250 may directly receive a (radio frequency) transmit signal, and may provide it to the respective antenna element.

In alternative examples, at least one of the first antenna element 110 and the second antenna element 120 may be configured to directly receive a (radio frequency) transmit signal. That is, the antenna elements may be directly fed.

However, using the indirect feeding for the antenna elements as illustrated in FIG. 2 may be advantageous in terms of providing a second antenna resonance. For example, the first coupling element 240 and/or the second coupling element 250 may be configured (designed) to resonate at a second resonance frequency (being different from the first resonance frequency of the antenna elements 110, 120). In some examples, the first and the second antenna elements 110, 120 may, e.g., resonate at 2.4 GHz, whereas the first and second coupling elements 240, 250 may resonate at 5.6 GHz. Accordingly, an antenna structure may be provided for a Wireless Local Area Network (WLAN) which supports transmission and reception at 2.4 GHz and 5.6 GHz. In other words, using the coupling elements as resonators for 5.6 GHz may allow to include a second resonance without increasing an overall volume of the antenna arrangement and without reducing the impedance bandwidth of the 2.4 GHz resonance.

In order to isolate the first and second coupling elements 240, 250 from each other, a first choke element 260 and a second choke element 270 may be used. The first and second choke elements 260, 270 have an inductance and capacitance. For example, the first and second choke elements 260, 270 may be made of metal. The first choke element 260 is arranged on the first surface between the first coupling element 240 and the second coupling element 250. The second choke element 270 is arranged on the second surface (i.e. the bottom side) between the second coupling element 250 and the first coupling element 240. A current emitting from the first coupling element 240 is reflected by the first choke element 260. A current emitting from the second coupling element 250 is reflected by the second choke element 270. Accordingly, a high isolation between the first and second coupling elements 240, 250 may be achieved, if these elements are used as radiators for the second resonance frequency.

The first and second antenna elements 110, 120 as well as the first and second choke elements 260, 270 of the antenna arrangement illustrated in FIG. 2 may further be coupled to ground potential. They may be either grounded directly or indirectly (e.g. via a coil). For a better overview, the connection to ground is omitted in the figures.

Figure 3:
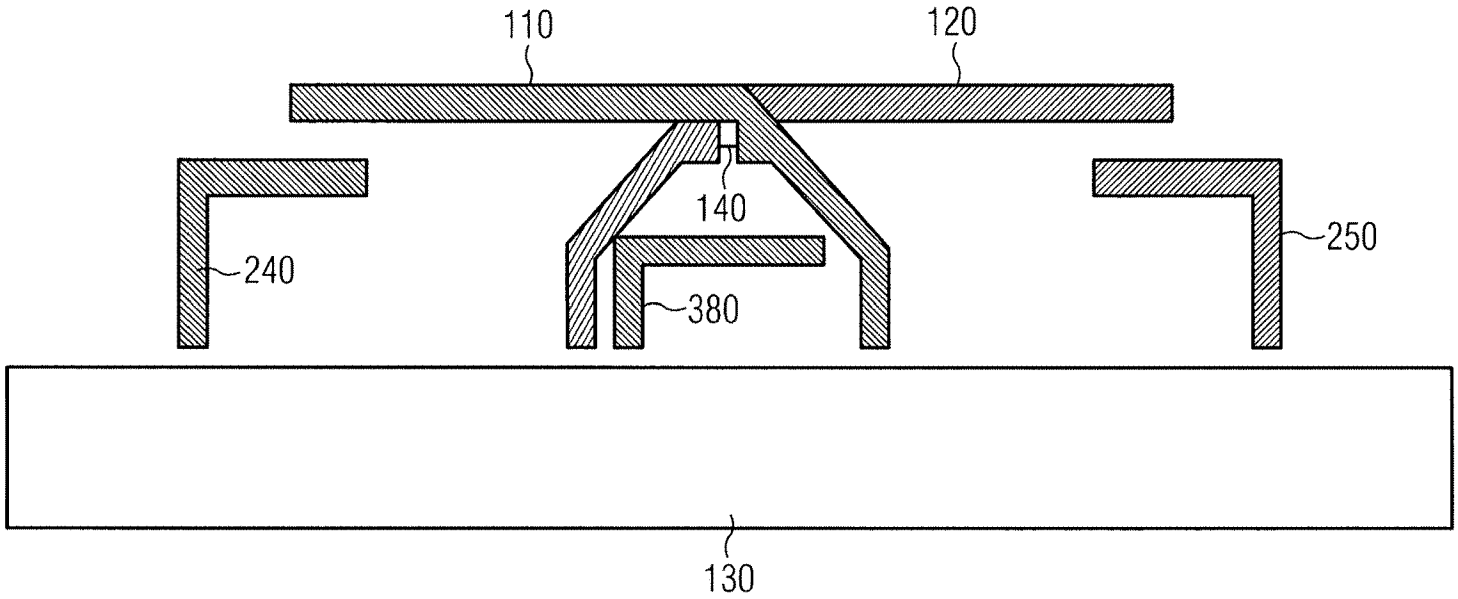
FIG. 3 illustrates a further example of an antenna arrangement.

An alternative antenna arrangement 300 using only a single first choke element 380 for isolating the first and second coupling elements 240, 250 is illustrated in FIG. 3. The example of FIG. 3 is similar to the one illustrated in FIG. 2. That is, the first antenna element 110 and the first coupling element 240 are arranged on a first surface of the support plane 130 (here the top side), whereas the second antenna element 120 and the second coupling element 250 are arranged on a second surface of the support plane 130 (here the bottom side). In contrast to the example illustrated in FIG. 2, the antenna arrangement 300 of FIG. 3 comprises only one single (first) choke element 380 for isolating the first and second coupling elements 240, 250. In FIG. 3, the first choke element 380 is arranged on the first surface of the support plane 130 between the first coupling element 240 and the second coupling element 250. It is evident that the first choke element 380 may alternatively be arranged on the second surface of the support plane 130 (i.e. the bottom side) between the second coupling element 250 and the first coupling element 240. Again, the first choke element 380 reflects a current emitting from one of the coupling elements in order to achieve a high isolation between these elements.

In alternative examples, the choke element(s) for isolating the first and second coupling elements 240, 250 may be arranged on an intermediate layer of the support plane 130 between the first coupling element 240 and the second coupling element 250. In other words, the choke element(s) may arranged on one of the surfaces of the support plane 130 or on an intermediate layer of the support plane 130 (if the support plane has a layered structure, e.g., a ten layer structure).

Also the first and second coupling elements 240, 250 may, in some examples, be arranged on an intermediate layer of the support plane 130. For example, both the first coupling element 240 and the second coupling element 250 may be arranged on the same intermediate layer of the support plane. Alternatively, the first and second coupling elements 240, 250 may be arranged on different intermediate layers of the support plane 130.

In other words, the antenna arrangement illustrated in FIGS. 2 and 3 may, e.g., consist of two single WLAN antennas (antenna elements). The two antennas may be mirrored versions of each other, placed on each side of the PCB and share part of the same volume. The isolation between the two antenna elements (for e.g. 2.4 GHz WLAN) is achieved by adding an inductor (inductance coil) at the cross point of the two antenna elements. This inductor creates a choke between the two elements, so that the RF (Radio Frequency) signal fed to the first coupler (coupling element) does not "see" the capacitive region of the second element in order to reduce the coupling to the second coupler (second RF feed). Two 5.6 GHz decoupling elements (standard choke parasitics) may be used to improve the isolation between the coupling elements (used as radiating elements for 5.6 GHz WLAN). Alternatively, one central placed 5.6 GHz choke element may be used as illustrated in FIG. 3.

Figure 4:
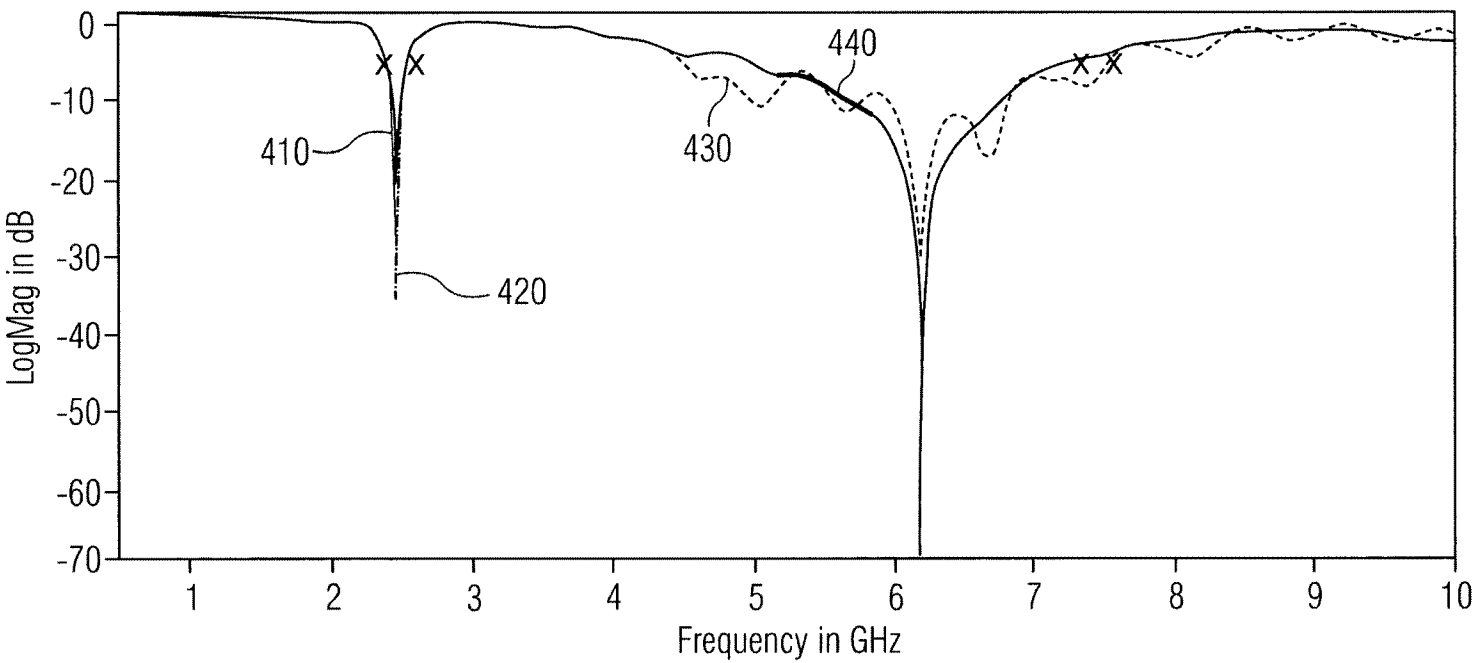
FIG. 4 illustrates an example course of the S11-parameter for the antenna arrangement illustrated in FIG. 3.

In FIG. 4, an example course of the S11-parameter for the antenna arrangement 300 of FIG. 3 is illustrated.

The abscissa denotes the frequency of the radiated or received signal, whereas the ordinate denotes the magnitude of the S11-parameter. The S11-parameter represents how much power is reflected from the antenna arrangement, and hence is known as the reflection coefficient. For example, if S11=0 dB (Decibel), then all power is reflected and nothing is delivered to the antenna element. If S11=−10 dB, this implies that 90% of power is delivered to the antenna and 10% of the power is reflected. It is evident from the highlighted regions 410, 420, 430 and 440 around 2.4 GHz and 5.6 GHz that the value of the S11-parameter for the antenna arrangement is lower than −6 dB, which indicates that the antenna arrangement is well matched in the interesting frequency ranges.

The value of the S11-parameter is further given for the lower end ("Lower TX/RX") and the upper end (Upper TX/RX") of the measuring ranges. It is evident from FIG. 4 that the value of the S11-parameter is better than approx. −8 dB. Hence, less than 15% of power is reflected by the antenna arrangement. Furthermore, high bandwidths for the respective radiating elements may be provided. For 2.4 GHz WLAN, a bandwidth of 84 MHz is commonly required. However, the antenna arrangement 300 of FIG. 3 provides a greater bandwidth of 136.6 MHz at 2.4 GHz. For 5.6 GHz, the antenna arrangement 300 provides a bandwidth of more than 2.3 GHz, which is by far greater than the conventionally required 700 MHz.

Figure 5:
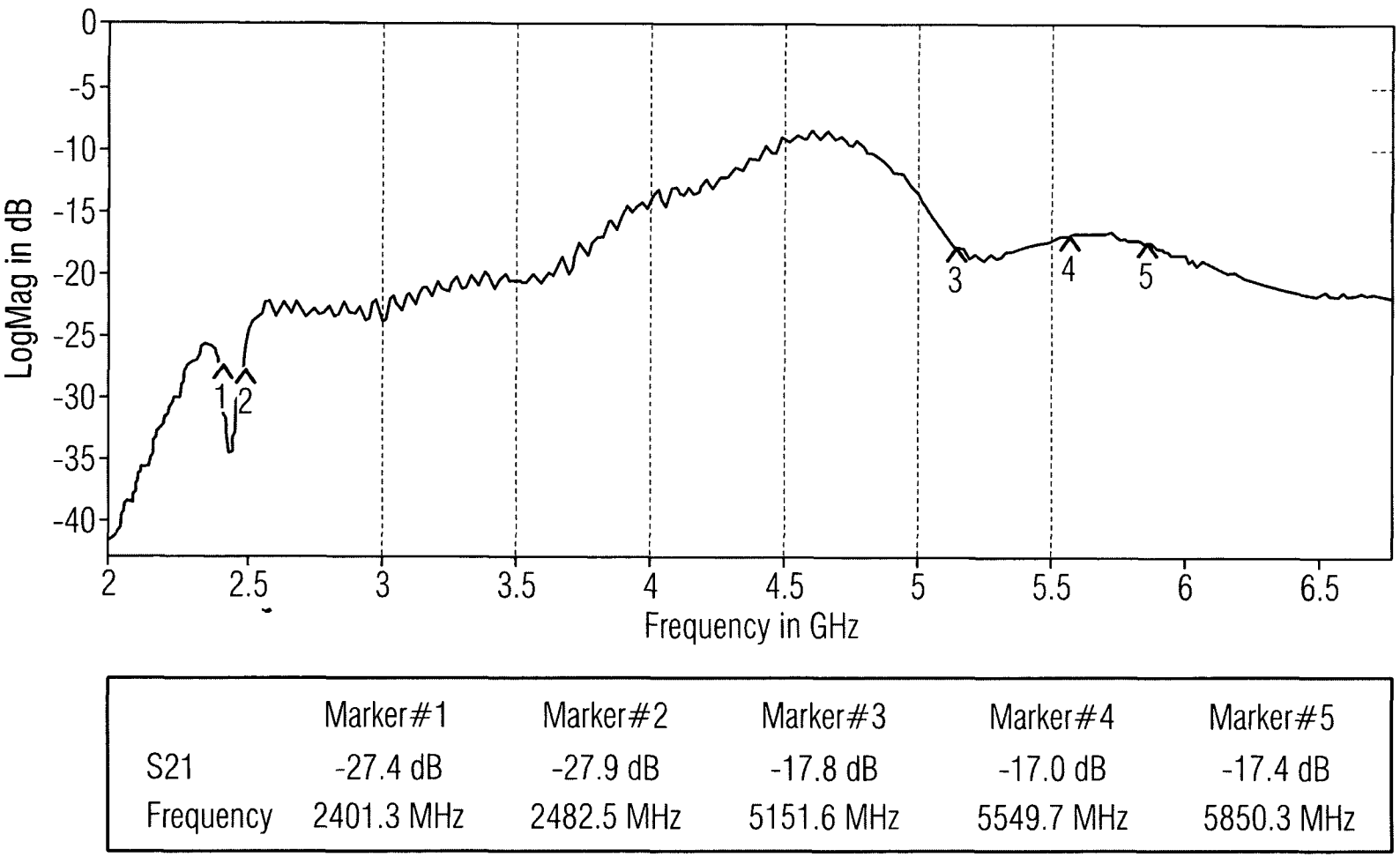
FIG. 5 illustrates an example course of the S21-parameter for the antenna arrangement illustrated in FIG. 3.

At the same time, the antenna elements may be spaced closely to each other as can be seen from FIG. 5, which illustrates the isolation between the individual antenna systems (antenna element+coupling element) of the antenna arrangement 300 illustrated in FIG. 3 in terms of the S21-parameter. The S21-parameter represents the power received at the second antenna element relative to the power input to the first antenna element. For instance, S21=0 dB implies that all the power delivered to the first antenna element ends up at the terminals of the second antenna element. If S21=−10 dB, then if 1 Watt (or 0 dB) is delivered to the first antenna element, −10 dB (0.1 Watt) of power is received and absorbed at the second antenna element.

For the frequency range around 2.4 GHz, the S21-parameter (i.e. the isolation) is approx. −27 dB and below. For the frequency range around 5.6 GHz, the S21-parameter is approx. −17 dB and below. It is evident from FIG. 5, that the S21-parameter values of the antenna systems are better than −12 dB, which is commonly considered as a threshold value for satisfying antenna isolation. Although the antenna systems are spaced closely together in FIG. 3, a high isolation is achieved.

In other words, both (WLAN) antennas are well match and isolated even though they share part of the same volume (i.e. they partly overlap). Regarding the efficiencies of the antennas of the antenna arrangement illustrated in FIG. 3, the first antenna system has a measured efficiency of −4.5 dB at 2.4 GHz and −2.75 dB at 5.6 GHz, whereas the second antenna system has an efficiency of −4.25 dB at 2.4 GHz and −3.0 dB at 5.6 GHz. Hence, the measured efficiencies of the two (WLAN) antennas further show that the good isolation between the antenna elements is not achieved by making the antennas lossy.

Figure 6:
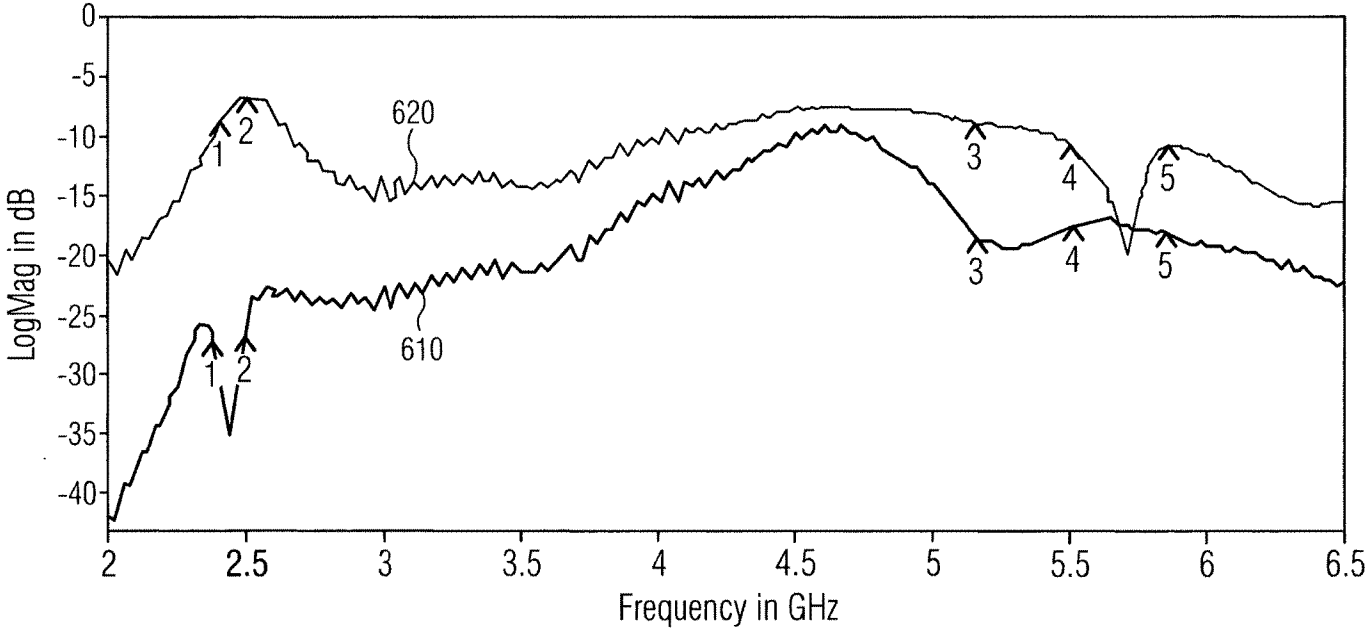
FIG. 6 illustrates an example of a comparison of courses of the S21-parameter for different antenna arrangements.

The effect of the inductance coil coupled to the first and second antenna elements 110, 120, and the first choke element 380 between the first and second coupling elements 240, 250 is illustrated in FIG. 6. In FIG. 6, the isolation between the antenna systems is again illustrated in terms of the S21-parameter. Curve 610 is identical to the curve illustrated in FIG. 5, which illustrates the situation that an inductance coil is coupled to the first and second antenna elements, and that the first choke element 380 is arranged between the first and second coupling elements. As a comparison, curve 620 illustrates a situation where no inductance coil is coupled to the first and second antenna elements, and where the first choke element 380 is not arranged between the first and second coupling elements. It is evident from curve 620, that the value for the S21-paraemter around 2.4 GHz is approx. −8 dB and better, and around 5.6 GHZ approx. −8 dB and better. That is, for both regions, the S21-parameter values are above the threshold of −12 dB, so that no sufficient isolation between the antenna systems is achieved. The inductance coil and the choke element allow an isolation improvement between the antenna systems of the antenna arrangement 300 of 10 to 20 dB for the above frequency regions.

Figure 7A:
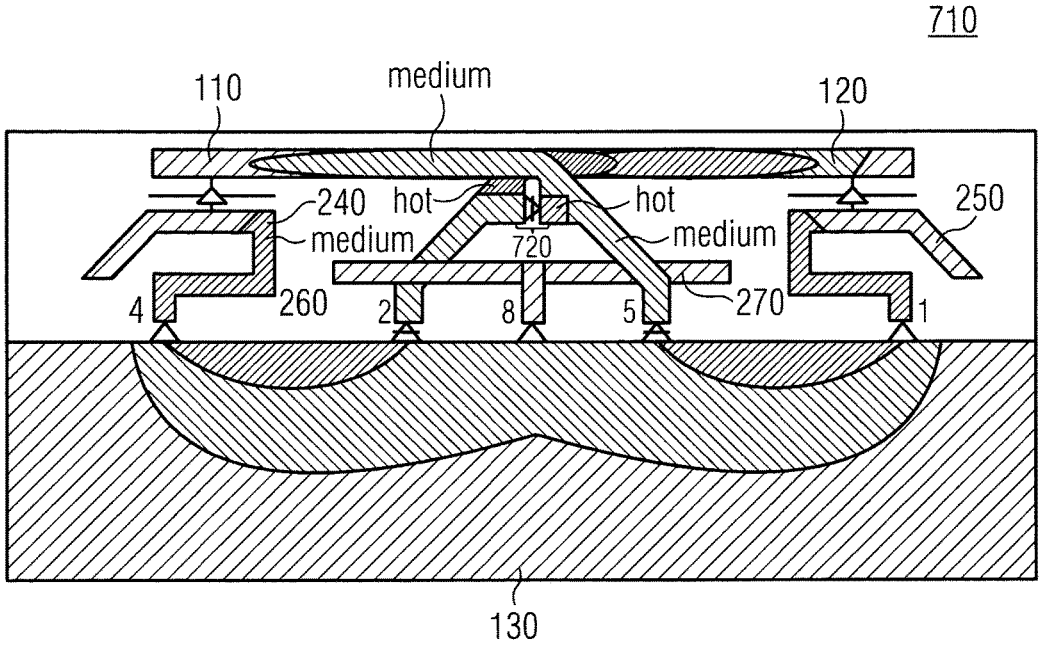
FIG. 7*a* illustrates a surface current of antenna arrangement comprising no inductance coil coupled to the antenna elements.
Figure 7B:
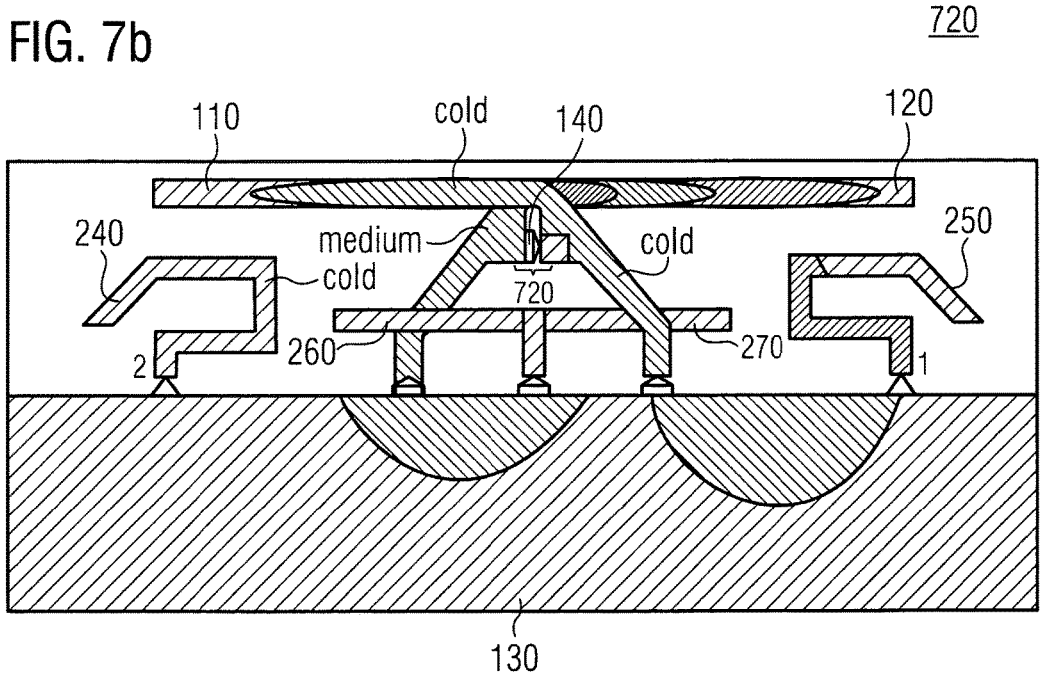
FIG. 7*b* illustrates a surface current of antenna arrangement comprising an inductance coil coupled to the antenna elements.

The effect of the inductance coil 140 in the antenna arrangement 200 of FIG. 2 is illustrated in FIGS. 7*a* and 7*b*, where a radio frequency feed signal is applied to the second coupling element (second antenna system). FIG. 7*a* illustrates the surface current of the antenna arrangement comprising no inductance coil coupled to the antenna elements 110, 120 as thermal image. It is evident from FIG. 7*a*, that a high surface current is present on both antenna elements in the central region 720 of the antenna arrangement (hot temperature), where the central section of the first and second antenna elements 110, 120 "overlap" (actually the first antenna element 110 overlaps with the orthogonal projection of the second antenna element 120 to the first surface, on which the first antenna element 110 is arranged). Also, medium surface currents are present on both coupling elements 240, 250, which indicates a low coupling between the two antenna systems (medium temperature).

In FIG. 7*b*, the surface current of the antenna arrangement 200 of FIG. 2 is illustrated as thermal image, i.e., compared to FIG. 7*a*, an inductance coil is coupled to both the first antenna element 110 and the second antenna element 120 in the central region 720. It is evident from FIG. 7*b*, that the currents running on the first antenna element 110 have been reduced to medium currents in the central region 720 of the antenna arrangement (medium temperature), and that almost no current (cold temperature) is present on the first coupling element 240, which indicates a high isolation between the two antenna systems.

Comparing the surface currents illustrated in FIGS. 7*a* and 7*b*, a great reduction of the surface current in the central region 720 and the adjacent sections of the first and second antenna elements 110, 120 due to the inductance coil 140 is evident. Hence, the inductance coil coupled to both the first and second antenna elements 110, 120 may allow an efficient decoupling of the antenna elements.

Figure 8:
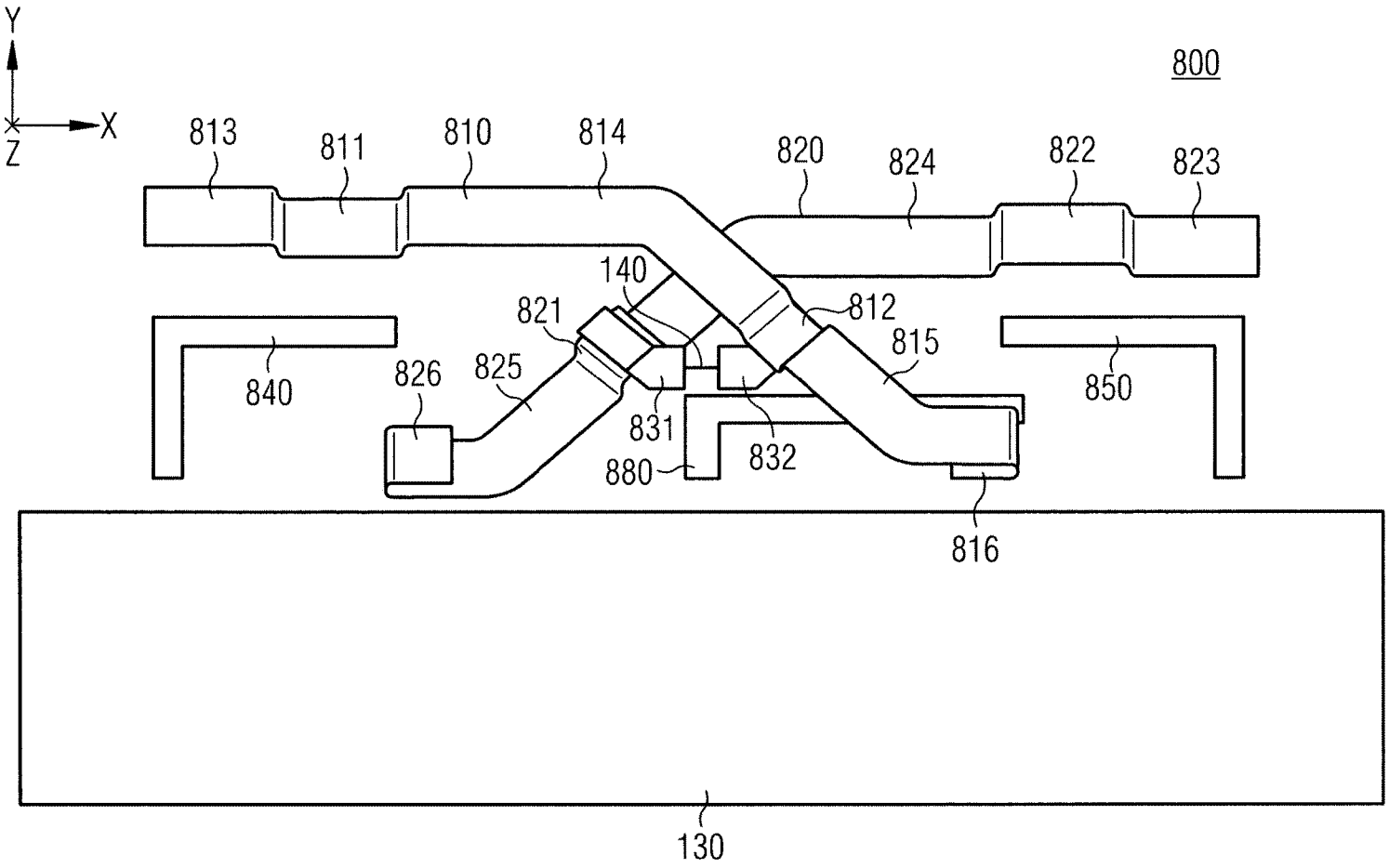
FIG. 8 illustrates another example of an antenna arrangement.
Figure 9:
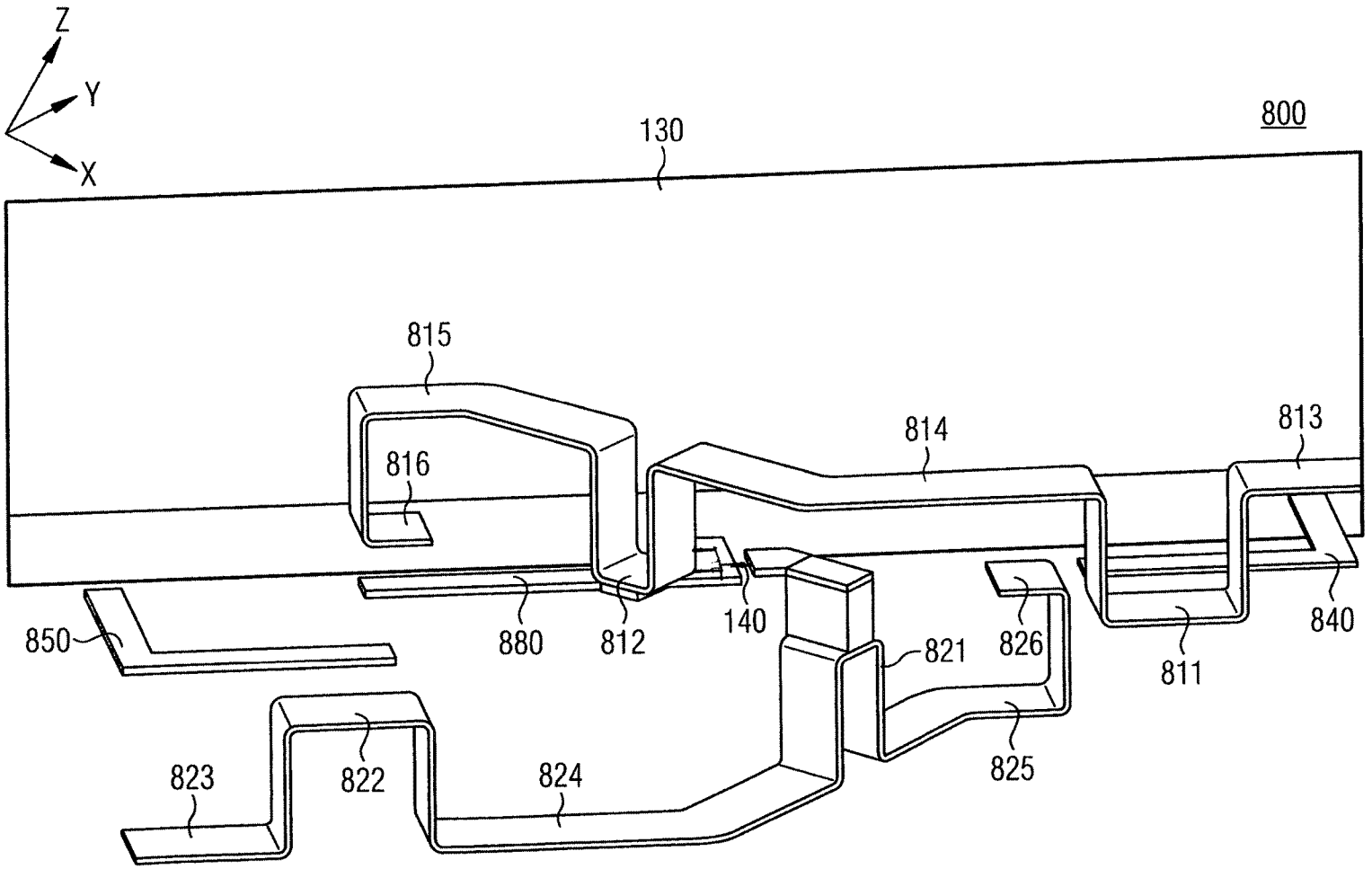
FIG. 9 illustrates a perspective view of the antenna arrangement illustrated in FIG. 8.

FIG. 8 and FIG. 9 illustrate another antenna arrangement 800 using three-dimensional antenna elements, wherein FIG. 8 illustrates a top view of the antenna arrangement 800 and FIG. 9 illustrates a perspective view of the antenna arrangement 800. Similar to the example illustrated in FIG. 3, the antenna arrangement 800 comprises a first antenna element 810 arranged on a first surface (top side) of the support plane 130, and a second antenna element 820 arranged on an opposite second surface (bottom side) of the support plane 130. An inductance coil 140 is coupled to both the first antenna element 810 and the second antenna element 820. As indicated in FIGS. 8 and 9, the inductance coil may, in some examples, be indirectly coupled to the first and second antenna elements by means of intermediate connecting elements 831, 832 (e.g. made of metal). As is evident from FIG. 9, the inductance coil 140 is arranged within the support plane 130 (e.g. a PCB). A first coupling element 840 is arranged on the first surface to capacitively couple to the first antenna element 810 in order to indirectly feed the first antenna element 810. A second coupling element 850 is arranged on the second surface to capacitively couple to the second antenna element 820 in order to indirectly feed the second antenna element 820.

In contrast to the first choke element 380 in FIG. 3, which is arranged on the first surface of the support plane 130, the first choke element 880 is arranged within the support plane 130 in FIGS. 8 and 9. In other words, the first choke element 880 in FIGS. 8 and 9 is arranged on an intermediate layer of the support plane 130 between the first coupling element 840 and the second coupling element 850.

Whereas the first and second antenna elements 110, 120 in FIG. 3 are substantially flat (i.e. the antenna elements don't have a structure in a direction orthogonal to the support plane), the first and second antenna elements 810, 820 in FIGS. 8 and 9 have a three-dimensional structure. For example, the first antenna element 810 comprises a first section 811, a third section 812 and a fourth section 816 contacting the support plane 130. Further, the first antenna element 810 comprises a second section 813, a fifth section 814 and a sixth section 815 having an orthogonal distance to the support plane 130. The orthogonal distance may, e.g., be 0.01 mm, 0.1 mm, 0.2 mm, 0.5 mm, 0.8 mm, 1 mm, 2 mm, 3 mm, 4 mm or 5 mm. In practice, the orthogonal distance may be determined by the height of a device housing the antenna arrangement 800. The maximum possible orthogonal distance (that is allowed by the device) may be chosen by a designer in order reduce radiation losses to the support plane 130 (e.g. a PCB). Similarly, the second antenna element 820 comprises a first section 821, a third section 822 and a fourth section 826 contacting the support plane 130, as well as a second section 823, a fifth section 824 and a sixth section 825 having an orthogonal distance to the support plane 130. In other words, the antenna elements may have at least one section contacting the support plane 130, and at least one other section being spaced apart from the support plane 130.

By spacing apart a part of the antenna element from the support plane 130, an energy loss of the antenna may be reduced. For example, for the support plane 130 being made of FR4 (Flame Retardant Class 4), thermal losses may be minimized compared to an antenna element having no spaced apart sections. Accordingly, an efficiency of the antenna elements may be increased. This is due to the fact, that a larger amount of the electromagnetic fields generated by the antenna element is radiated to the surrounding air instead to the support plane 130. Moreover, placing the antenna elements on different sides of the support plane 130 may increase an impedance bandwidth of the antenna elements due to the increased antenna volumes. For example, the antenna elements 810, 820 illustrated in FIGS. 8 and 9 may be self-supported metal stamped elements.

However, also for flat antenna elements, thermal losses may be minimized by appropriately choosing the material for the support plane 130. Hence, the efficiency of the flat antenna may be affected by choosing appropriate materials for the support plane.

Figure 10:
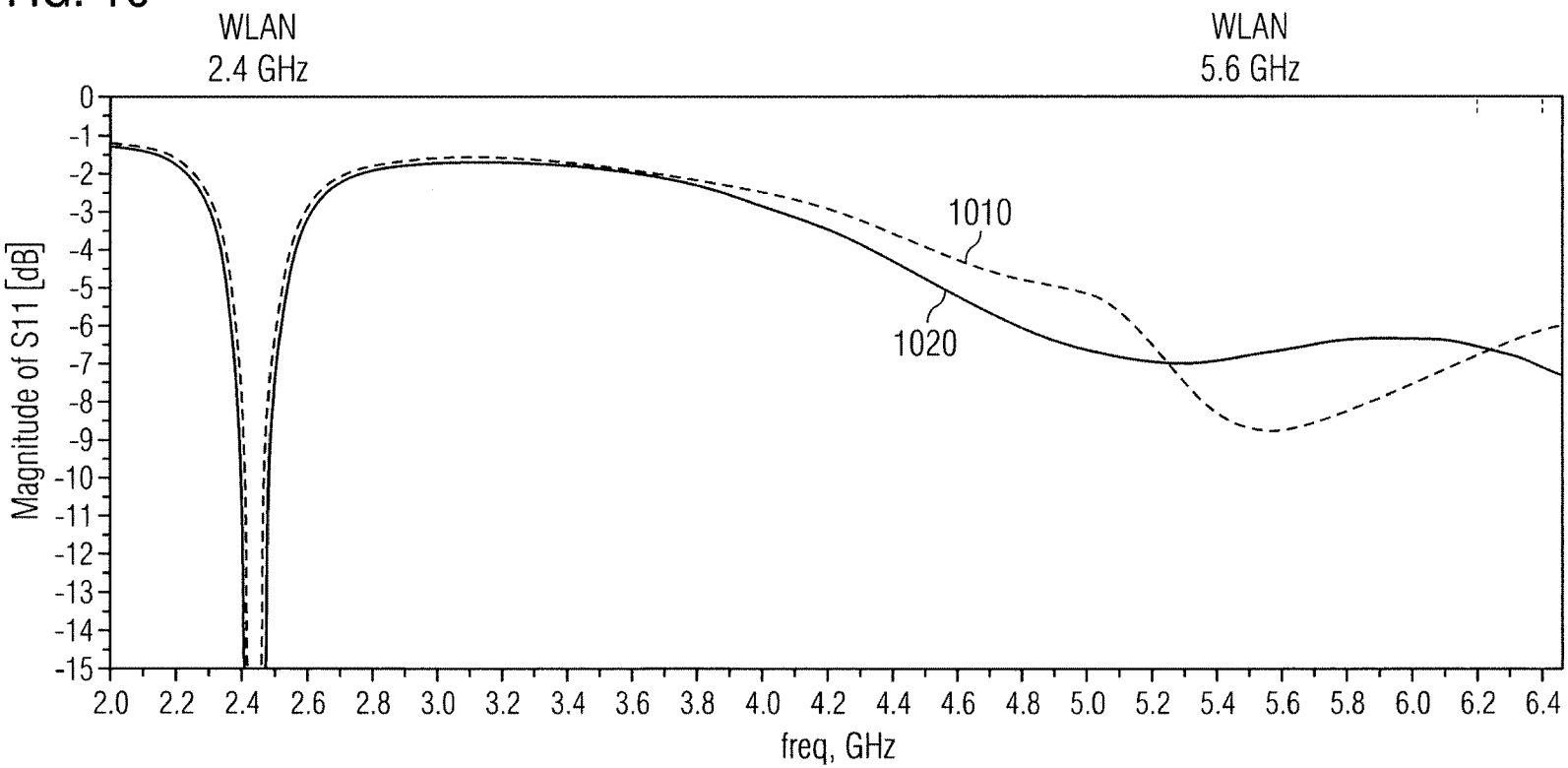
FIG. 10 illustrates an example course of the S11-parameter for the antenna arrangement illustrated in FIG. 9.

In FIG. 10, example courses of the S11-parameter for the antenna arrangement 800 of FIGS. 8 and 9 are illustrated. In the example illustrated, the antenna elements 810, 820 are configured to resonate at 2.4 GHz and the coupling elements 840, 850 are configured to resonate at 5.6 GHz. Curve 1010 represents the value of the S11-parameter for the first antenna system (antenna element 810+first coupling element 840), whereas curve 1020 represents the value of the S11-parameter for the second antenna system (antenna element 820+second coupling element 850). It is evident from FIG. 10 that for the interesting frequency ranges at 2.4 GHz and 5.6 GHz, the values of the S11-parameter are below the −6 dB threshold for good antenna performance. The slight deviation of the curves for frequencies higher than approx. 4 GHz is due to the fact that only a single choke element, which is not symmetric, is used for isolating (decoupling) the first and second coupling elements. However, both curves are far below the −6 dB threshold.

Figure 11:
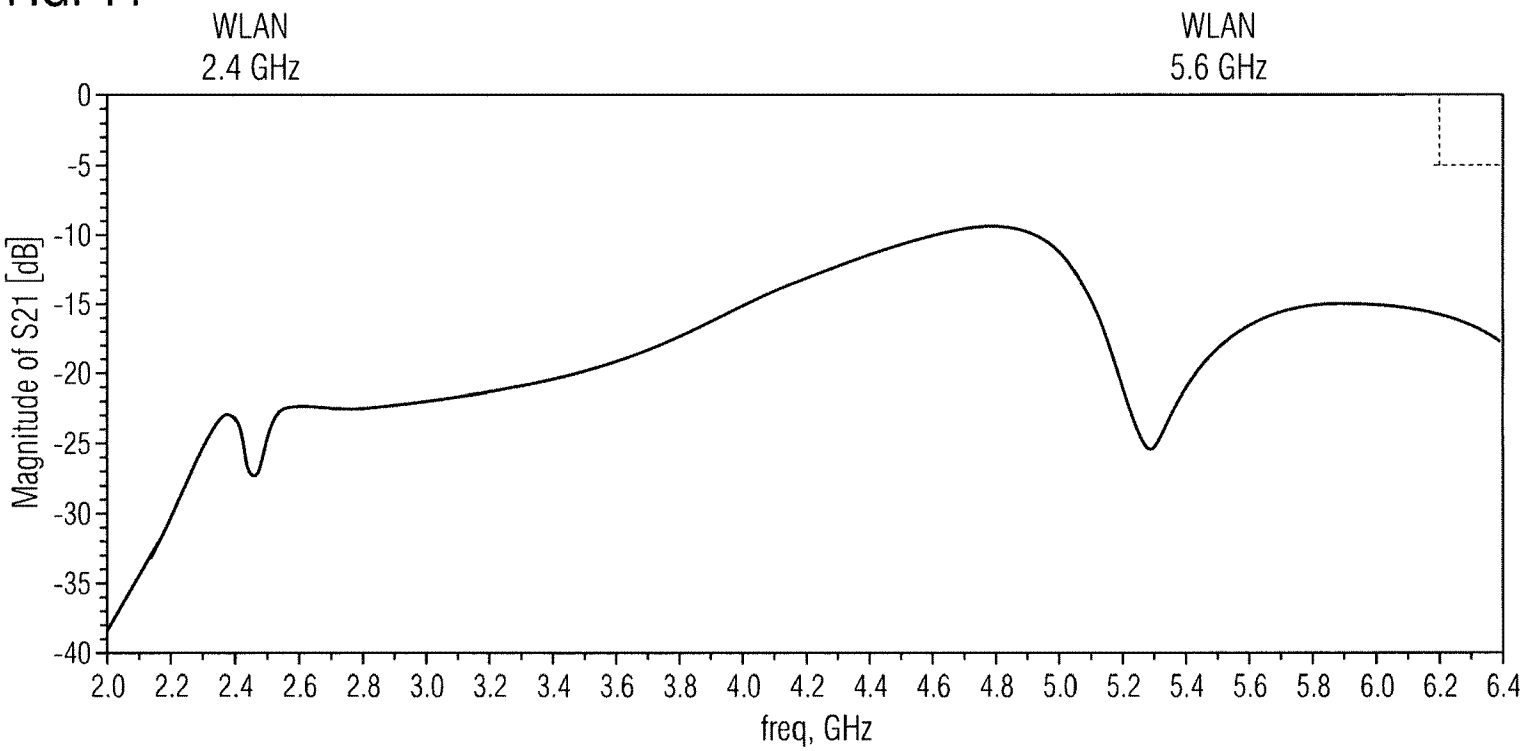
FIG. 11 illustrates an example of a comparison of courses of the S21-parameter for the antenna arrangement illustrated in FIG. 9.

The isolation course between the antenna systems is illustrated in FIG. 11 in terms of the S21-parameter. It is evident from FIG. 11 that the values of the S21-parameter in the interesting frequency ranges at 2.4 GHz and 5.6 GHz are much lower than the −12 dB threshold for a sufficient isolation between both antenna systems.

In other words, FIGS. 10 and 11 may illustrate that the antenna elements are well matched and have a very good isolation. Further, due to the three-dimensional structure of the antenna elements 810, 820, an efficiency of the whole antenna arrangement 800 may be high (e.g. higher compared to the flat structure illustrated in FIG. 2).

Figure 12:
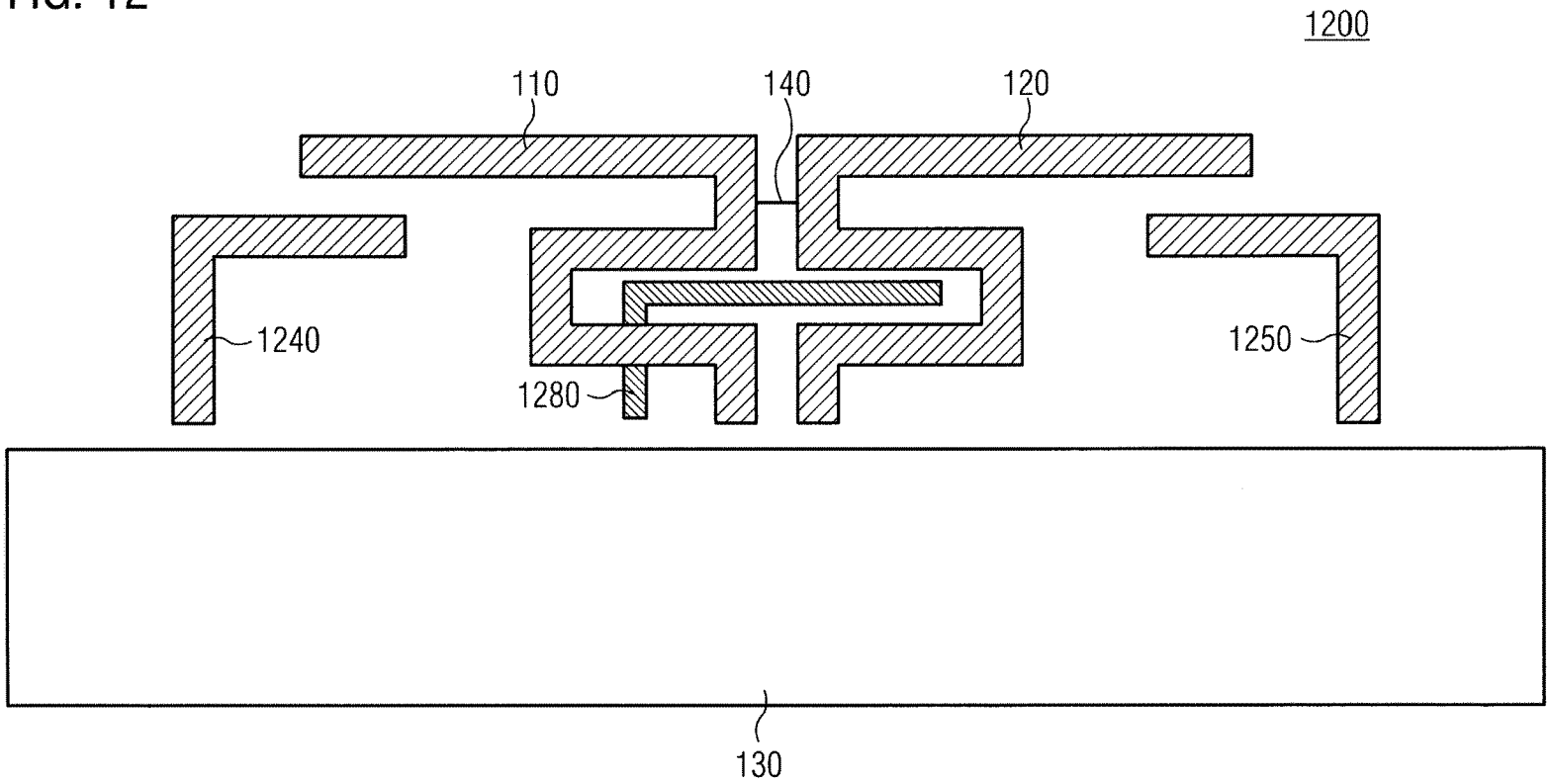
FIG. 12 illustrates a further example of an antenna arrangement.

In FIG. 12, a further antenna arrangement 1200 is illustrated. In the antenna arrangement 1200, the first antenna element 110 and the second antenna element 120 are arranged on a same surface of the support plane 130 (e.g. the top side or the bottom side), wherein the inductance coil 140 is coupled to both antenna elements.

Accordingly, the first coupling element 1240 is arranged on this (the same) surface of the support plane 130. Again, the first coupling element 1240 is galvanically isolated from the first antenna element 110 and capacitively couples to the first antenna element 110. Also the second coupling element 1250 is arranged on this surface of the support plane 130. The second coupling element 1250 is galvanically isolated from the second antenna element 120 and capacitively couples to the second antenna element 120.

Using the first and second coupling elements 1240, 1250 may again allow to indirectly feed a transmit signal to the first and second antenna elements 110, 120, respectively, and to match the impedance of the first and second antenna elements 110, 120 to 50Ω. Alternatively, a direct feed for the antenna elements 110, 120 may be provided by directly providing the transmit signal to the antenna elements. In other words, at least one of the first antenna element 110 and the second antenna element 120 may directly receive a (radio frequency) transmit signal in a direct feed implementation (not comprising the coupling element 1240, 1250).

For isolating (decoupling) the first and second coupling elements 1240, 1250, a first choke element 1280 is arranged. In the example illustrated in FIG. 12, the first choke element 1280 is arranged on an intermediate layer of the support plane 130 between the first coupling element 1240 and the second coupling element 1250. That is, the first choke element 1280 is arranged within the support plane 130 (having a layered structure). In alternative examples, the first choke element may be on a surface of the support plane 130 between the first coupling element 1240 and the second coupling element 1250. However, arranging the first choke element 1280 on an intermediate layer of the support plane 130 may allow to increase a physical size (extension) of the first choke element 1280 compared to arranging it on the surface of the support plane 130. Increasing the physical size of the first choke element 1280 may allow to improve an isolation (decoupling) between the first and second coupling elements 1240, 1250. Accordingly, an impedance bandwidth of the first and second coupling elements 1240, 1250 (acting as resonators for radiating an electromagnetic wave to the environment) may be increased.

Figure 13:
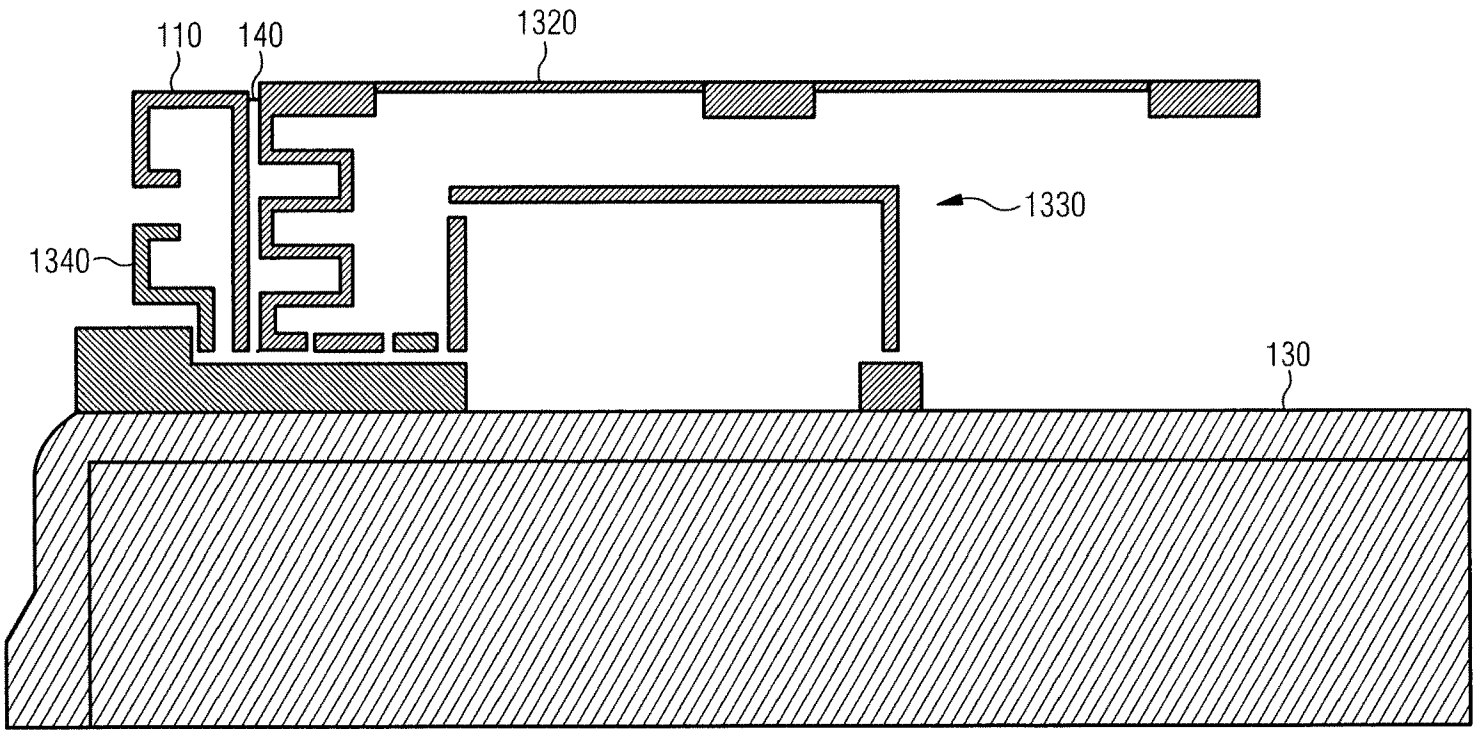
FIG. 13 illustrates another example of an antenna arrangement.

FIG. 13 illustrates another antenna arrangement 1300. In the antenna arrangement 1300, the first antenna element 110 radiates an electromagnetic wave according to a first transmission standard. For example, the first transmission standard may be a transmission standard for a WLAN (e.g. the IEEE 802.11 standard). A first coupling element 1340 that capacitively couples to the first antenna element 110 is used to indirectly feed the first antenna element 110. The second antenna element 1320 radiates an electromagnetic wave according to a different second transmission standard. For example, the second transmission standard may be a transmission standard for a cellular network (e.g. GSM, UMTS, LTE . . . ). The second antenna element 1320 is part of a cellular antenna system 1330.

For example the cellular antenna system 1330 may be configured to resonate at frequencies between 699 MHz and 960 MHz as well as from 1710 MHz to 2690 MHz. The first antenna element may, e.g., be configured to resonate at 2.4 GHz, and the first coupling element may, e.g., configured to resonate at 5.6 GHz in order to provide a WLAN system having resonances at 2.4 GHz and 5.6 GHz. That is, at least the 2.4 GHz resonance of the WLAN systems is within the frequency range of the cellular system 1330. Accordingly, a simultaneous operation of both systems might cause disturbances in conventional systems. However, by coupling the inductance coil 140 to the first antenna element 110 and the second antenna element 1320, the first antenna 110 may be efficiently isolated from the second antenna element 1320. Hence, the WLAN system may be efficiently isolated from the cellular system. Compared to conventional approaches, this may allow to reduce a distance between both antenna structures within a mobile communications device, which commonly requires both transmission techniques.

Figure 14:
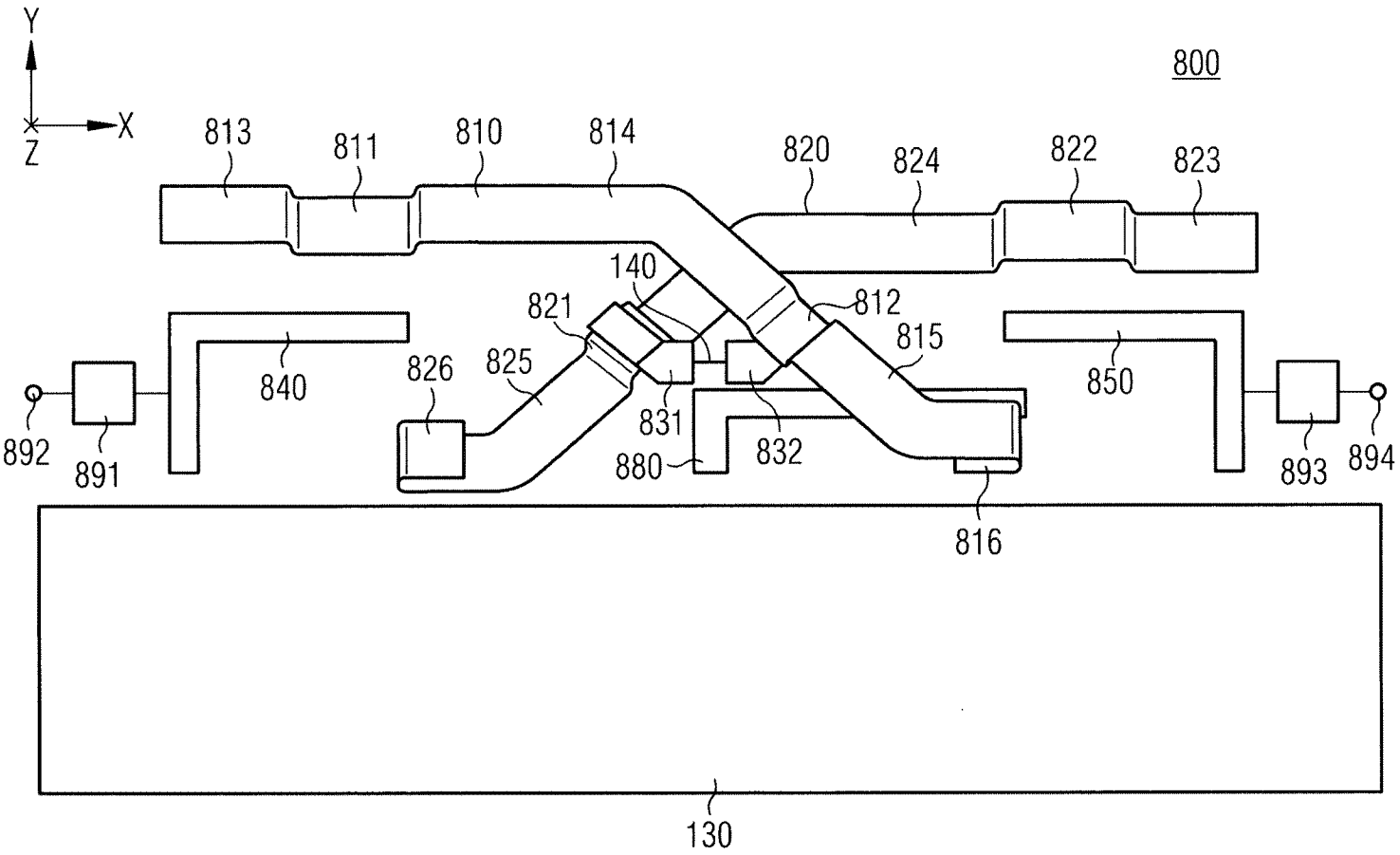
FIG. 14 illustrates a further example of an antenna arrangement.

FIG. 14 illustrates a further antenna arrangement 899, which is similar to the antenna arrangement 800 illustrated in FIGS. 8 and 9. In contrast to the antenna arrangement 800 of FIGS. 8 and 9, a (radio frequency) transmit signal is not directly fed to the first and second coupling elements 840, 850.

Therefore, the antenna arrangement 899 additionally comprises a first terminal 892 (serving as antenna feed for the first antenna element 810) configured to receive the (radio frequency) transmit signal. Further, the antenna arrangement 899 comprises a first impedance matching element 891 (e.g. an inductive element, a capacitive element, or an inductance coil), which is coupled to the first terminal 892 and the first coupling element 840. Accordingly, the impedance of the first coupling element 840 may be matched with the impedance of the first terminal 892. More general, the first impedance matching element 891 may allow to match an impedance of the antenna system formed by the first antenna element 810 and the first coupling element 840 with the impedance of a transceiver (not illustrated) coupled to the antenna system by means of the first terminal 892. Compared to the antenna arrangement 800 of FIGS. 8 and 9, a distance between the first antenna element 810 and the first coupling element 840 may be increased in order to reduce the capacitive coupling between the first antenna element 810 and the first coupling element 840 in order the achieve a broadband impedance match.

Similarly, a second terminal 894 (serving as antenna feed for the second antenna element 820) for receiving a (radio frequency) transmit signal, and a second impedance matching element 893 coupled to the second terminal 894 and the second coupling element 850 is provided for impedance matching. Also a distance between the second antenna element 820 and the second coupling element 850 may be increased compared to the antenna arrangement 800 of FIGS. 8 and 9 in order to reduce the coupling between the second antenna element 820 and the second coupling element 850 in order the achieve a broadband impedance match.

In alternative implementations, one or more further choke elements may be used in addition to the choke element 880.

Figure 15:
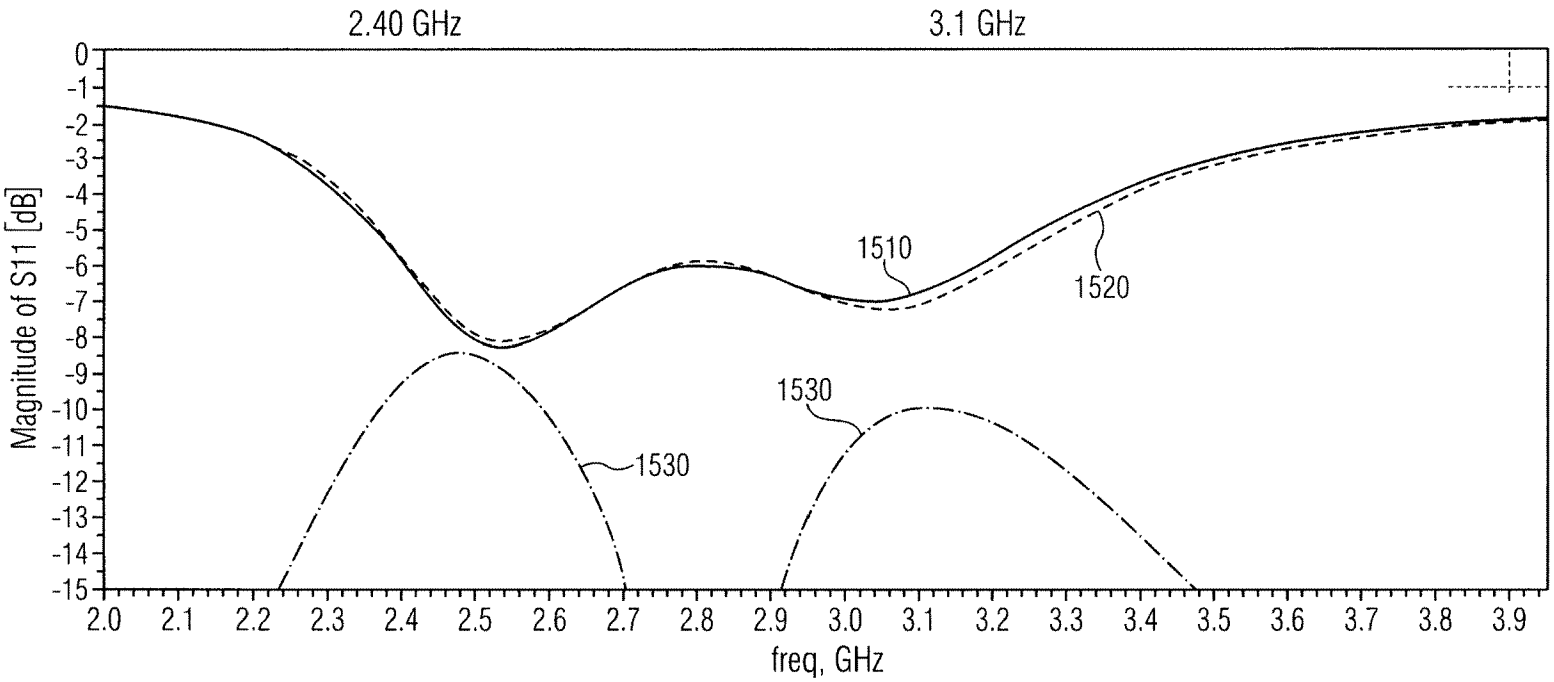
FIG. 15 illustrates example courses of the S11-parameter and the S21-parameter for a variation of the antenna arrangement illustrated in FIG. 14.

Providing the terminals and the impedance matching elements may allow to increase frequency bandwidths of the antenna systems for the trade-off of losing the second resonance (of the first and second coupling elements 840, 850). This is evident from FIG. 15, which illustrates example courses of the S11-parameter and an example course of the S21-parameter for a variation of the antenna arrangement 899 illustrated in FIG. 14. In the variation of FIG. 15, the choke element 880 is omitted compared to the antenna arrangement 899 of FIG. 14.

It is evident from curves 1510 (for the first antenna system comprising the first coupling element and the first antenna element) and 1520 (for the second antenna system comprising the second coupling element and the second antenna element) that the value of the S11-parameter is better than the −6 dB threshold value within a frequency range from approx. 2.4 GHz to approx. 3.1 GHz. Compared to the situation illustrated in FIG. 10, where the transmit signals are directly feed to the first and second coupling elements 840, 850 of the antenna arrangement 800 illustrated in FIGS. 8 and 9, the usable frequency range (approx. 700 MHz) is about 6 to 7 times broader. The isolation between both antenna systems is better than −8 dB for the whole frequency range. In other words, for the trade-off of losing the second resonance, a frequency bandwidth of the antenna arrangement at the single resonance of the antenna arrangement may be increased. That is, an antenna arrangement with two single resonance broadband antenna elements may be provided.

In order to increase the isolation between both antenna systems, the choke element 880 may be used as illustrated for the antenna arrangement 899 of FIG. 14. This is evident from FIG. 16, which illustrates example courses of the S11-parameter and an example course of the S21-parameter for the antenna arrangement 899 illustrated of FIG. 14. The curves 1610 (for the first antenna system) and 1620 (for the second antenna system) illustrate the respective values of the S11-parameter for both antenna systems, which is below the −6 dB threshold between approx. 2.4 GHz and approx. 2.9 GHz. Compared to FIG. 15, the usable frequency range is reduced to approx. 500 MHz, which is however still approx. 5 times the usable frequency range of the direct feeding approach illustrated in FIG. 10. It is evident from curve 1630 that compared to FIG. 15, the value of the S21-parameter is below the −12 dB threshold for the whole usable frequency range between approx. 2.4 GHz and approx. 2.9 GHz. Hence, the antenna arrangement 899 of FIG. 14 is an example of a well matched antenna arrangement with two single resonance broadband antenna elements.

Figure 17:
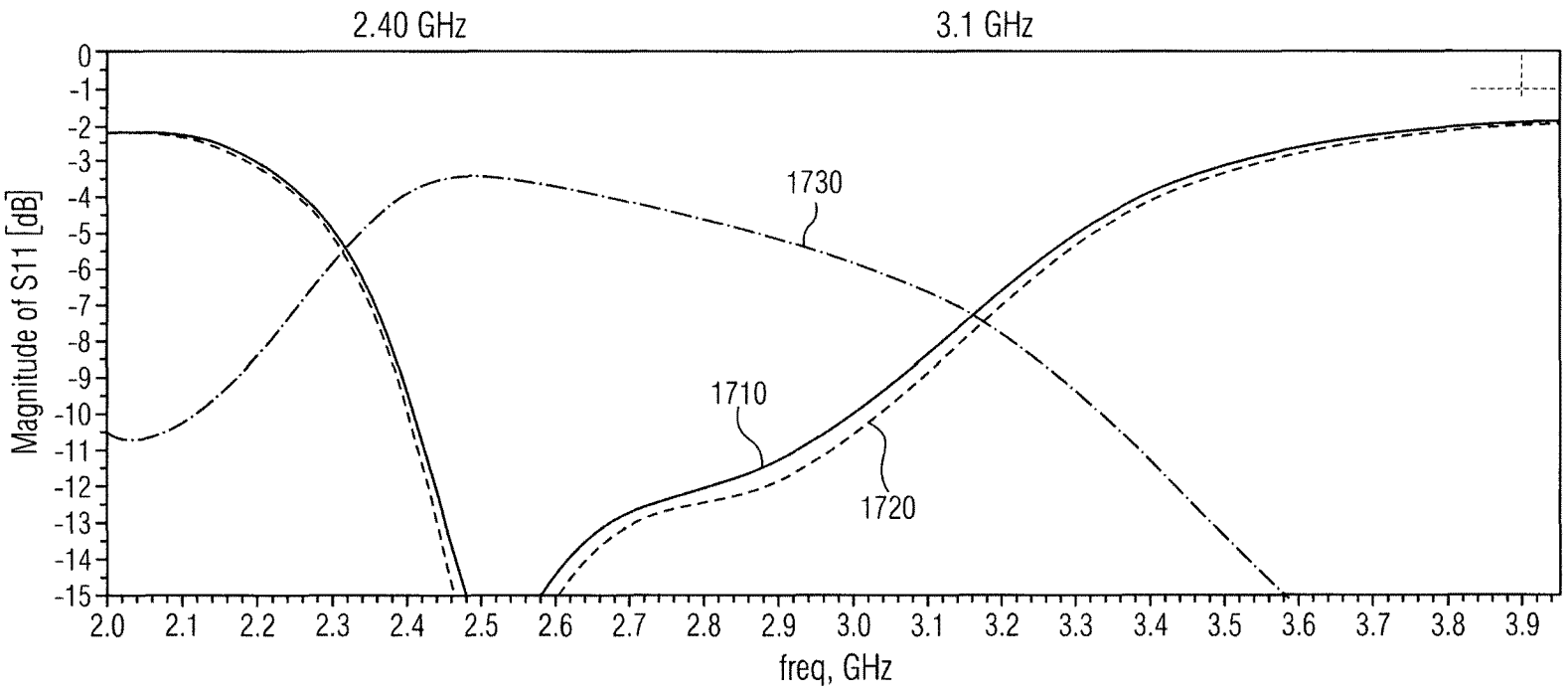
FIG. 17 illustrates example courses of the S11-parameter and the S21-parameter for another variation of the antenna arrangement illustrated in FIG. 14.

As a reference, FIG. 17 illustrates example courses of the S11-parameter and an example course of the S21-parameter for another variation of the antenna arrangement 899 illustrated of FIG. 14. In the variation of FIG. 17, the inductance coil 140 and the choke element 880 are omitted compared to the antenna arrangement 899 of FIG. 14.

It is evident from curves 1710 (for the first antenna system) and 1720 (for the second antenna system) that the value of the S11-parameter is below the −6 dB threshold between approx. 2.4 GHz and approx. 3.1 GHz. However, the value of the S21-parameter is worse than the −12 dB threshold over the whole frequency range. Hence, it is evident from FIG. 17 that the inductance coil 140 is mandatory for efficiently isolating both antenna systems. In other words, the inductance coil 140 allows to minimize a distance between the first and second antenna elements, while maintaining a sufficient isolation between both antenna systems.

Figure 16:
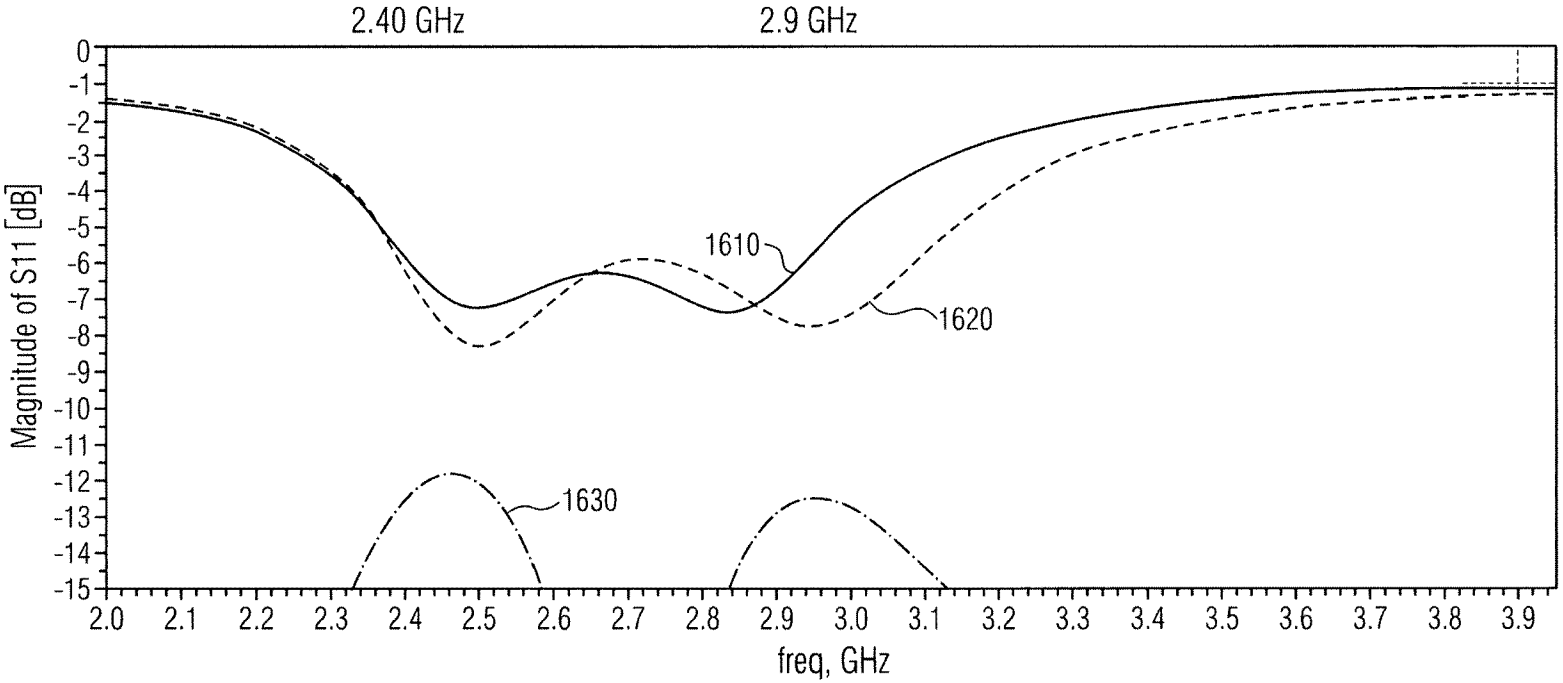
FIG. 16 illustrates example courses of the S11-parameter and the S21-parameter for the antenna arrangement illustrated in FIG. 14.

It is to be noted that in FIGS. 15 to 17 arbitrary frequency ranges are illustrated in order to give evidence for the increased frequency bandwidths of the antenna systems. The frequency ranges of FIGS. 15 to 17 are not tuned to a commercially used frequency range (e.g. around 2.4 GHz for WLAN). However, it is evident for a person skilled in the art that equivalent commercially usable frequency ranges may be achieved by tuning the above described exemplary antenna arrangements.

Figure 18:
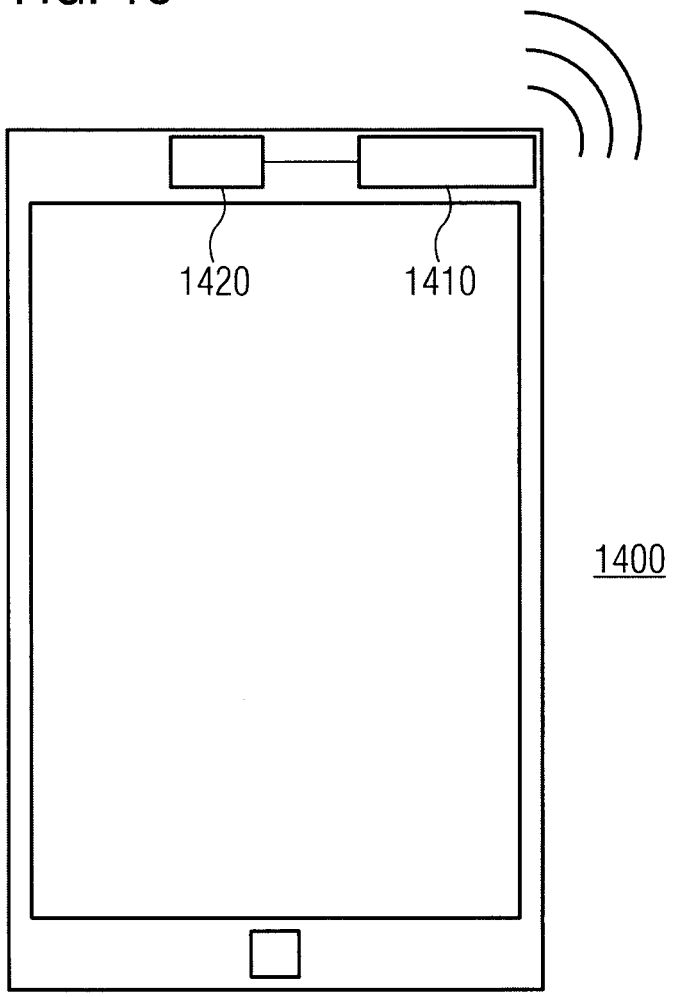
FIG. 18 illustrates an example of a mobile communications device comprising an antenna arrangement.

An example of an implementation using an antenna arrangement according to one or more aspects of the proposed concept or one or more examples described above is illustrated in FIG. 18. FIG. 18 schematically illustrates an example of a mobile communications device or mobile phone or user equipment 1400 comprising an antenna arrangement 1410 according to an example described herein. A transceiver 1420 may be coupled to the antenna arrangement 1410. To this end, mobile communications devices may be provided having reduced bezel size. Hence, improved designs for mobile communications device may be enabled.

The examples as described herein may be summarized as follows:

Example 1 is an antenna arrangement comprising a first antenna element, a second antenna element and an inductance coil coupled to both the first antenna element and the second antenna element.

In example 2, the antenna arrangement of example 1 further comprises a first coupling element being galvanically isolated from the first antenna element, wherein the first coupling element is configured to capacitively couple to the first antenna element, and a second coupling element being galvanically isolated from the second antenna element, wherein the second coupling element is configured to capacitively couple to the second antenna element.

In example 3, the first coupling element or the second coupling element of the antenna arrangement of example 2 is configured to directly receive a radio frequency transmit signal.

In example 4, the antenna arrangement of example 2 further comprises a terminal configured to receive a radio frequency transmit signal, and an impedance matching element coupled to the terminal and the first coupling element.

In example 5, the impedance matching element of the antenna arrangement of example 4 is an inductance coil.

In example 6, the antenna arrangement of any of examples 2 to 5 further comprises a first choke element being arranged between the first coupling element and the second coupling element.

In example 7, the antenna arrangement of example 6 further comprises a second choke element being arranged between the first coupling element and the second coupling element.

In example 8, at least one of the first antenna element and the second antenna element of the antenna arrangement of example 1 or example 2 is configured to directly receive a radio frequency transmit signal.

In example 9, the first antenna element and the second antenna element of the antenna arrangement of any of the preceding examples are arranged on a same surface of a support plane.

In example 10, the first antenna element of the antenna arrangement of any of examples 1 to 8 is arranged on a first surface of a support plane, wherein the second antenna element is arranged on a second surface of the support plane, the second surface being opposite to the first surface.

In example 11, the first antenna element of the antenna arrangement of any of examples 1 to 8 is arranged on a surface of a support plane, wherein the second antenna element is arranged on an intermediate layer of the support plane.

In example 12, the first antenna element of the antenna arrangement of any of examples 1 to 8 is arranged on a first intermediate layer of a support plane, wherein the second antenna element is arranged on a second intermediate layer of the support plane.

In example 13, an extension of the first antenna element of the antenna arrangement of any examples 9 to 12 along a first spatial axis is at least partly equal to an extension of the second antenna element along the first spatial axis, wherein an extension of the first antenna element along an orthogonal second spatial axis is at least partly equal to an extension of the second antenna element along the second spatial axis, the first spatial axis and the second spatial axis spanning the support plane.

In example 14, the first antenna element of the antenna arrangement of any of examples 9, 10 or 11 comprises a first section contacting the support plane, and a second section having an orthogonal distance to the support plane.

In example 15, the first antenna element and the second antenna element of the antenna arrangement of any of the preceding examples are both configured to resonate at a same first resonance frequency.

In example 16, the first resonance frequency of the antenna arrangement of example 15 is about 2.4 GHz.

In example 17, the first coupling element and the second coupling element of the antenna arrangement of example 2 are configured to resonate at a same second resonance frequency.

In example 18, the second resonance frequency of the antenna arrangement of example 17 is about 5.6 GHz.

In example 19, the first antenna element of the antenna arrangement of any of examples 1 to 14 is configured to radiate an electromagnetic wave according to a first transmission standard, wherein the second antenna element is configured to radiate an electromagnetic wave according to a different second transmission standard.

In example 20, the first transmission standard of the antenna arrangement of example 19 is a transmission standard for a wireless local area network, wherein the second transmission standard is a transmission standard for a cellular network.

Example 21 is a mobile communications device comprising an antenna arrangement according to any of examples 1 to 20.

In example 22, a transceiver is coupled to the antenna arrangement in the mobile communications device of example 21.

The aspects and features mentioned and described together with one or more of the previously detailed examples and figures, may as well be combined with one or more of the other examples in order to replace a like feature of the other example or in order to additionally introduce the feature to the other example.

The description and drawings merely illustrate the principles of the disclosure. It will thus be appreciated that those skilled in the art will be able to devise various arrangements that, although not explicitly described or shown herein, embody the principles of the disclosure and are included within its spirit and scope. Furthermore, all examples recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions. Moreover, all statements herein reciting principles, aspects, and examples of the disclosure, as well as specific examples thereof, are intended to encompass equivalents thereof.

It is to be understood that the disclosure of multiple acts, processes, operations, steps or functions disclosed in the specification or claims may not be construed as to be within the specific order, unless explicitly or implicitly stated otherwise, for instance for technical reasons. Therefore, the disclosure of multiple acts or functions will not limit these to a particular order unless such acts or functions are not interchangeable for technical reasons. Furthermore, in some examples a single act, function, process, operation or step may include or may be broken into multiple sub-acts, -functions, -processes, -operations or -steps, respectively. Such sub acts may be included and part of the disclosure of this single act unless explicitly excluded.

Furthermore, the following claims are hereby incorporated into the detailed description, where each claim may stand on its own as a separate example. While each claim may stand on its own as a separate example, it is to be noted that—although a dependent claim may refer in the claims to a specific combination with one or more other claims—other example examples may also include a combination of the dependent claim with the subject matter of each other dependent or independent claim. Such combinations are explicitly proposed here-in unless it is stated that a specific combination is not intended. Furthermore, it is intended to include also features of a claim to any other independent claim even if this claim is not directly made dependent to the independent claim.

What is claimed is:

1. An antenna arrangement, comprising:

a first antenna element;

a second antenna element that at least partially overlaps with the first antenna element within a crossing region, the first antenna element and the second antenna element being disposed on different surfaces of a common support plane;

an inductance coil that is formed by an inductor that is conductively coupled to the first antenna element and the second antenna element at the crossing region;

a first coupling element being galvanically isolated from the first antenna element, wherein the first coupling element is configured to capacitively couple to the first antenna element;

a second coupling element being galvanically isolated from the second antenna element, wherein the second coupling element is configured to capacitively couple to the second antenna element; and a first choke element disposed on the same surface of the common support plane as the first antenna element and at least partially overlapping with the second antenna element.

2. The antenna arrangement of claim 1, wherein the first coupling element or the second coupling element is configured to directly receive a radio frequency signal.

3. The antenna arrangement of claim 1, wherein the first choke element is arranged between the first coupling element and the second coupling element.

4. The antenna arrangement of claim 3, wherein the antenna arrangement further comprises a second choke element arranged between the first coupling element and the second coupling element.

5. The antenna arrangement of claim 4, wherein the first choke element and the second choke element are symmetrical about an axis bisecting the first antenna element and the second antenna element.

6. The antenna arrangement of claim 1, wherein at least one of the first antenna element and the second antenna element is configured to directly receive a radio frequency signal.

7. The antenna arrangement of claim 1, wherein the first antenna element is arranged on a surface of the common support plane, and wherein the second antenna element is arranged on an intermediate layer of the common support plane.

8. The antenna arrangement of claim 1, wherein the first antenna element is arranged on a first intermediate layer of the common support plane, and wherein the second antenna element is arranged on a second intermediate layer of the common support plane.

9. The antenna arrangement of claim 1, wherein an extension of the first antenna element along a first spatial axis is at least partly equal to an extension of the second antenna element along the first spatial axis, and wherein an extension of the first antenna element along an orthogonal second spatial axis is at least partly equal to an extension of the second antenna element along the second spatial axis, the first spatial axis and the second spatial axis spanning the common support plane.

10. The antenna arrangement of claim 1, wherein the first antenna element and the second antenna element are configured to resonate at a same resonant frequency.

11. The antenna arrangement of claim 10, wherein the first same resonant frequency is equal to 2.4 GHz.

12. The antenna arrangement of claim 1, wherein the first coupling element and the second coupling element are configured to resonate at a same resonant frequency.

13. The antenna arrangement of claim 12, wherein the same resonant frequency is equal to 5.6 GHz.

14. The antenna arrangement of claim 1, wherein the inductance coil increases isolation measured between the first coupling element and the second coupling element compared to an absence of the inductance coil.

15. The antenna arrangement of claim 14, wherein the first choke element further increases isolation measured between the first coupling element and the second coupling element compared to an absence of the first choke element.

16. The antenna arrangement of claim 1, wherein the inductance coil is configured to block currents between the first antenna element and the second antenna element, and wherein the first choke element is configured to block currents between the first coupling element and the second coupling element.

17. A mobile device, comprising:

a transceiver; and an antenna arrangement coupled to the transceiver, the antenna arrangement including:

a first antenna element;

a second antenna element that at least partially overlaps with the first antenna element within a crossing region, the first antenna element and the second antenna element being disposed on different surfaces of a common support plane;

an inductance coil that is formed by an inductor that is conductively coupled to the first antenna element and the second antenna element at the crossing region;

a first coupling element being galvanically isolated from the first antenna element, wherein the first coupling element is configured to capacitively couple to the first antenna element;

a second coupling element being galvanically isolated from the second antenna element, wherein the second coupling element is configured to capacitively couple to the second antenna element; and a first choke element disposed on the same surface of the common support plane as the first antenna element and at least partially overlapping with the second antenna element.

18. The mobile device of claim 17, wherein the first choke element is arranged between the first coupling element and the second coupling element.

19. The mobile device of claim 18, wherein the antenna arrangement further includes a second choke element arranged between the first coupling element and the second coupling element.

* * * * *